US009052669B2

(12) United States Patent
Tomita et al.

(10) Patent No.: US 9,052,669 B2
(45) Date of Patent: Jun. 9, 2015

(54) LUBRICANT APPLICATOR, IMAGE FORMING APPARATUS, AND PROCESS CARTRIDGE

(71) Applicants: Daisuke Tomita, Kanagawa (JP); Takeshi Shintani, Kanagawa (JP); Norio Kudo, Kanagawa (JP); Kenji Honjoh, Kanagawa (JP); Satoshi Hatori, Kanagawa (JP); Naohiro Kumagai, Kanagawa (JP); Akira Fujimori, Kanagawa (JP); Kaoru Yoshino, Tokyo (JP); Yuta Azeyanagi, Kanagaway (JP); Hideyasu Seki, Chiba (JP); Ryohta Gotoh, Tokyo (JP)

(72) Inventors: Daisuke Tomita, Kanagawa (JP); Takeshi Shintani, Kanagawa (JP); Norio Kudo, Kanagawa (JP); Kenji Honjoh, Kanagawa (JP); Satoshi Hatori, Kanagawa (JP); Naohiro Kumagai, Kanagawa (JP); Akira Fujimori, Kanagawa (JP); Kaoru Yoshino, Tokyo (JP); Yuta Azeyanagi, Kanagaway (JP); Hideyasu Seki, Chiba (JP); Ryohta Gotoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/936,669

(22) Filed: Jul. 8, 2013

(65) Prior Publication Data

US 2014/0037303 A1 Feb. 6, 2014

(30) Foreign Application Priority Data

Jul. 31, 2012 (JP) ..... 2012-169993

(51) Int. Cl.
*G03G 15/00* (2006.01)
*G03G 21/00* (2006.01)

(52) U.S. Cl.
CPC ..... *G03G 15/553* (2013.01); *G03G 21/0094* (2013.01)

(58) Field of Classification Search
CPC ..... G03G 15/553; G03G 21/0094
USPC ..... 399/24, 346, 324, 325
See application file for complete search history.

(56) References Cited

U.S. PATENT DOCUMENTS

| | | | |
|---|---|---|---|
| 2005/0164108 | A1 | 7/2005 | Murakami et al. |
| 2007/0059067 | A1 | 3/2007 | Tanaka et al. |
| 2007/0172273 | A1 | 7/2007 | Harada et al. |
| 2007/0258743 | A1 | 11/2007 | Shakuto et al. |
| 2008/0181689 | A1 | 7/2008 | Fujimori |
| 2009/0060600 | A1 | 3/2009 | Ninomiya et al. |
| 2009/0103944 | A1 | 4/2009 | Shintani et al. |
| 2010/0021205 | A1 | 1/2010 | Honjoh et al. |
| 2010/0183349 | A1 | 7/2010 | Shintani et al. |
| 2011/0076075 | A1 | 3/2011 | Arai et al. |

(Continued)

FOREIGN PATENT DOCUMENTS

| | | |
|---|---|---|
| JP | 8-314346 | 11/1996 |
| JP | 2010-271665 | 12/2010 |

OTHER PUBLICATIONS

Hatori et al. U.S. Appl. No. 14/289,925, filed May 29, 2014.*

*Primary Examiner* — Rodney Bonnette
(74) *Attorney, Agent, or Firm* — Oblon, McClelland, Maier & Neustadt, L.L.P.

(57) ABSTRACT

A lubricant applicator includes a block of lubricant, a supply member contactable against the block of lubricant to scrape the block of lubricant, and a lubricant gauge including a first electrode and a second electrode. The lubricant gauge is electrically connected to the first electrode and the second electrode to detect whether an amount of lubricant remaining is less than a threshold value based on establishment of electrical continuity between the first electrode and the second electrode. One of the first electrode and the second electrode includes a projection projecting toward the other one of the first electrode and the second electrode.

20 Claims, 14 Drawing Sheets

(56) References Cited

U.S. PATENT DOCUMENTS

| | | | | |
|---|---|---|---|---|
| 2011/0123239 | A1 | 5/2011 | Azeyanagi et al. | |
| 2011/0170908 | A1 | 7/2011 | Saitoh et al. | |
| 2011/0217101 | A1 | 9/2011 | Okamoto et al. | |
| 2011/0229232 | A1 | 9/2011 | Kojima et al. | |
| 2012/0195661 | A1 | 8/2012 | Karasawa et al. | |
| 2012/0315053 | A1 | 12/2012 | Kudo et al. | |
| 2012/0321330 | A1 | 12/2012 | Kudo et al. | |
| 2013/0234449 | A1 | 9/2013 | Hatori et al. | |
| 2013/0251380 | A1 | 9/2013 | Fujimori et al. | |
| 2013/0251381 | A1 | 9/2013 | Seki et al. | |
| 2013/0251382 | A1* | 9/2013 | Honjoh et al. | 399/25 |
| 2013/0279923 | A1 | 10/2013 | Gotoh et al. | |
| 2014/0037302 | A1* | 2/2014 | Gotoh et al. | 399/24 |
| 2014/0037304 | A1* | 2/2014 | Uenishi et al. | 399/24 |

* cited by examiner

LUBRICANT APPLICATOR, IMAGE FORMING APPARATUS, AND PROCESS CARTRIDGE

CROSS-REFERENCE TO RELATED APPLICATION

This patent application is based on and claims priority pursuant to 35 U.S.C. §119 to Japanese Patent Application No. 2012-169993, filed on Jul. 31, 2012, in the Japan Patent Office, the entire disclosure of which is hereby incorporated by reference herein.

BACKGROUND

1. Technical Field

Exemplary aspects of the present invention generally relate to a lubricant applicator, an image forming apparatus including the lubricant applicator, and a process cartridge included in the image forming apparatus.

2. Related Art

Related-art image forming apparatuses, such as copiers, printers, facsimile machines, and multifunction devices having two or more of copying, printing, and facsimile capabilities, typically form a toner image on a recording medium (e.g., a sheet of paper, etc.) according to image data using, for example, an electrophotographic method. In the electrophotographic method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus. The image forming apparatuses often further include a lubricant applicator that supplies a lubricant to a surface of an image carrier, such as the photoconductor and an intermediate transfer belt included in the transfer device, for protection and reduced friction.

However, when image formation is performed with the lubricant used up and not supplied to the image carrier, the image carrier, which is not protected by the lubricant, abrades and deteriorates. To solve this problem, the lubricant applicator often includes a lubricant detector that detects a stage in which the lubricant is almost used up (hereinafter referred to as a near-end stage of the lubricant).

FIG. 1 is a schematic perspective view illustrating an example of a configuration of a lubricant detector included in a related-art lubricant applicator.

The lubricant applicator illustrated in FIG. 1 includes a lubricant holder 143 formed of an electrically conductive material, a solid lubricant 140 held by the lubricant holder 143, and first and second electrode members 181 and 182 that contact both ends of the lubricant holder 143, respectively, when the solid lubricant 140 has a small amount remaining. A detection circuit 183 is connected to both the first and second electrode members 181 and 182, and applies a voltage between the first and second electrode members 181 and 182 to detect whether or not an electric current flows therebetween. The lubricant holder 143 is biased toward a supply member, not shown, by springs 142.

In the early stage of use of the solid lubricant 140, the lubricant holder 143 is positioned away and thus electrically isolated from both the first and second electrode members 181 and 182, so that no electric current flows between the first and second electrode members 181 and 182. As the solid lubricant 140 is gradually scraped off by the supply member over time, the lubricant holder 143 is moved toward the supply member by a biasing force of the springs 142. When the solid lubricant 140 reaches the near-end stage, the conductive lubricant holder 143 contacts the first and second electrode members 181 and 182. As a result, an electric current flows between the first and second electrode members 181 and 182, so that the detection circuit 183 detects the near-end stage of the solid lubricant 140.

However, as described above, the lubricant holder 143 contacts the first and second electrode members 181 and 182 when the solid lubricant 140 reaches the near-end stage, so that electrical continuity is established between the first and second electrode members 181 and 182. In other words, the lubricant holder 143 is positioned away and thus electrically isolated from both the first and second electrode members 181 and 182 from the early stage of use of the solid lubricant 140 until the near-end stage. Consequently, until the solid lubricant 140 reaches the near-end stage, powdered lubricant scraped off from the solid lubricant 140 may adhere to a contact portion in which the lubricant holder 143 and the first or second electrode member 181 or 182 contact each other. Adherence of the powdered lubricant to the contact portion hinders establishment of electrical continuity between the first and second electrode members 181 and 182 even when the lubricant holder 143 contacts the first and second electrode members 181 and 182, thereby possibly preventing detection of the near-end stage of the solid lubricant 140.

SUMMARY

In view of the foregoing, illustrative embodiments of the present invention provide a novel lubricant applicator that reliably detects that a remaining amount of a solid lubricant is smaller than a threshold value. Illustrative embodiments of the present invention also provide an image forming apparatus including the lubricant applicator, and a process cartridge included in the image forming apparatus.

In one illustrative embodiment, a lubricant applicator includes a block of lubricant, a supply member contactable against the block of lubricant to scrape the block of lubricant, and a lubricant gauge including a first electrode and a second electrode. The lubricant gauge is electrically connected to the first electrode and the second electrode to detect whether an amount of lubricant remaining is less than a threshold value based on establishment of electrical continuity between the first electrode and the second electrode. One of the first electrode and the second electrode includes a projection projecting toward the other one of the first electrode and the second electrode.

In another illustrative embodiment, an image forming apparatus includes an image carrier, from which an image formed thereon is transferred onto a recording medium to form the image on the recording medium, and the lubricant applicator described above. The lubricant applicator is disposed opposite the image carrier to supply the lubricant to a surface of the image carrier.

In yet another illustrative embodiment, a process cartridge detachably installable in an image forming apparatus includes an image carrier and the lubricant applicator described above.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
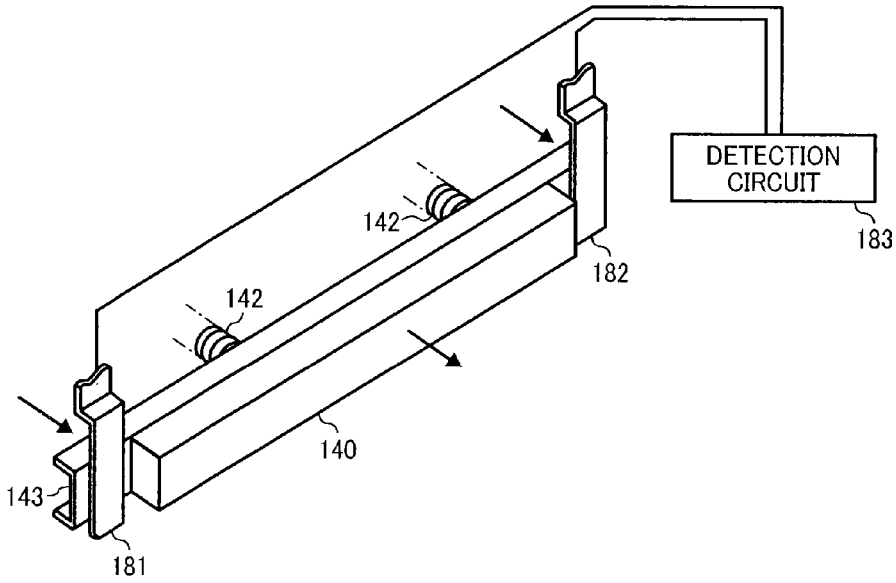
FIG. 1 RELATED ART
FIG. 1 is a schematic perspective view illustrating an example of a configuration of a lubricant detector included in a related-art lubricant applicator.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have substantially the same function, operate in a similar manner, and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A configuration and operation of an image forming apparatus 10 according to illustrative embodiments are described in detail below.

Figure 2:
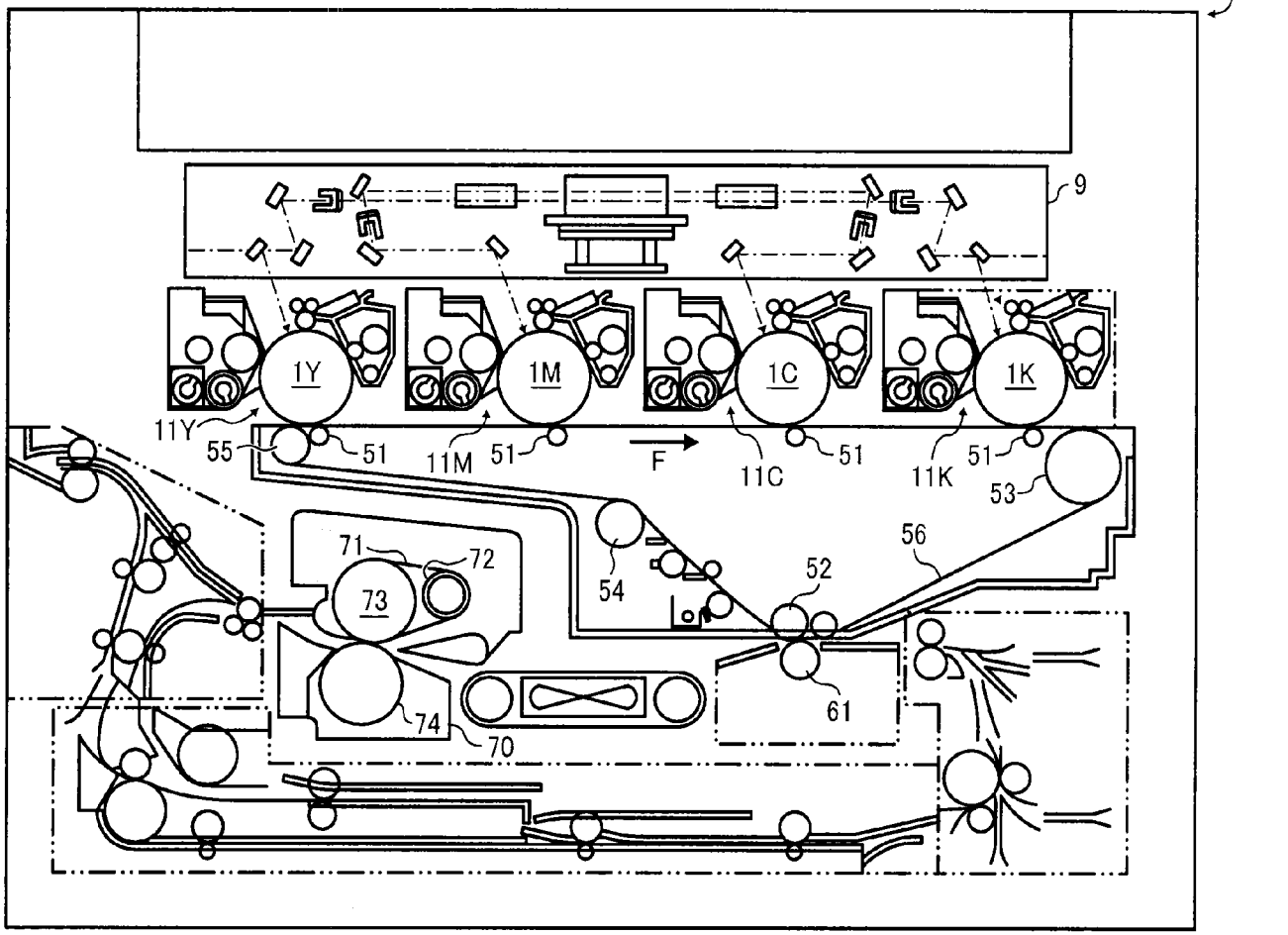
FIG. 2 is a vertical cross-sectional view illustrating an example of a configuration of an image forming apparatus according to illustrative embodiments.

FIG. 2 is a vertical cross-sectional view illustrating an example of a configuration of the image forming apparatus 10.

The image forming apparatus 10 is a printer employing an electrophotographic method and includes an intermediate transfer belt 56 serving as an image carrier. The intermediate transfer belt 56 is an endless belt formed of a heat resistant material such as polyimide and polyamide, and includes a base with medium resistance. The intermediate transfer belt 56 is disposed substantially at the center of the image forming apparatus 10 and is wound around rollers 52, 53, 54, and 55 to be rotatively driven in a clockwise direction indicated by arrow F in FIG. 2. Four imaging units 11Y,11M, 11C, and 11K (hereinafter collectively referred to as imaging units 11), each forming a toner image of a specific color, that is, yellow (Y), magenta (M), cyan (C), or black (K), are disposed side by side along a direction of rotation of the intermediate transfer belt 56 above the intermediate transfer belt 56.

Figure 3:
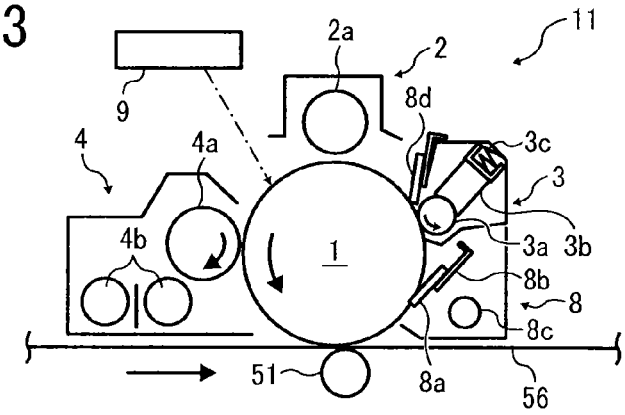
FIG. 3 is an enlarged vertical cross-sectional view illustrating an example of a configuration of a process cartridge included in the image forming apparatus.

FIG. 3 is an enlarged vertical cross-sectional view illustrating an example of a configuration of one of the imaging units 11 included in the image forming apparatus 10. It is to be noted that the imaging units 11 have the same basic configuration, differing only in a color of toner used. Therefore, suffixes Y, M, C, and K, each indicating a color of toner used, are hereinafter omitted. The imaging unit 11 includes an image carrier, which in the present illustrative embodiment, is a photoconductor 1. A charger 2 that evenly charges a surface of the photoconductor 1 such that the photoconductor 1 has a predetermined negative polarity, a developing device 4 that develops an electrostatic latent image formed on the surface of the photoconductor 1 with negatively charged toner to form a toner image on the surface of the photoconductor 1, a lubricant applicator 3 that supplies lubricant to the surface of the photoconductor 1, and a cleaning device 8 that cleans the surface of the photoconductor 1 after transfer of the toner image from the photoconductor 1 onto the intermediate transfer belt 56 are disposed around the photoconductor 1.

The photoconductor 1, the charger 2, the developing device 4, the cleaning device 8, and the lubricant applicator 3, each included in the imaging unit 11, are formed together as a single integrated process cartridge detachably installable in the image forming apparatus 10, and thus integrally replaceable with a new imaging unit 11.

Returning to FIG. 2, an electrostatic latent image forming device, which, in the present illustrative embodiment, is an irradiating device 9, is disposed above the imaging units 11. The irradiating device 9 irradiates the charged surface of each photoconductor 1 with light based on image data of the corresponding color to form an electrostatic latent image on the surface of each photoconductor 1. Inside the loop of the intermediate transfer belt 56, primary transfer devices, which, in the present illustrative embodiment, are primary transfer rollers 51, are disposed opposite photoconductors 1Y, 1M, 1C, and 1K (hereinafter collectively referred to as photoconductors 1), respectively, with the intermediate transfer belt 56 interposed therebetween. The primary transfer rollers 51 primarily transfer the toner images formed on the photoconductors 1 onto the intermediate transfer belt 56, so that the toner images are sequentially superimposed one atop the other on the intermediate transfer belt 56 to form a single full-color toner image on the intermediate transfer belt 56. The primary transfer rollers 51 are connected to a power source, not shown, by which a predetermined voltage is applied.

Outside the loop of the intermediate transfer belt 56, a secondary transfer device, which, in the present illustrative embodiment, is a secondary transfer roller 61, is disposed opposite the roller 52 with the intermediate transfer belt 56 interposed therebetween. The secondary transfer roller 61 is pressed against the roller 52 via the intermediate transfer belt 56. The secondary transfer roller 61 is connected to a power source, not shown, by which a predetermined voltage is applied. The secondary transfer roller 61 and the intermediate transfer belt 56 contact each other at a secondary transfer position where the full-color toner image formed on the intermediate transfer belt 56 is secondarily transferred onto a recording medium such as a transfer sheet. A fixing device 70 that fixes the toner image onto the transfer sheet is disposed downstream from the secondary transfer position in a direction of conveyance of the transfer sheet. The fixing device 70 includes a heat roller 72, within which a halogen heater is disposed, a fixing roller 73, an endless fixing belt 71 wound around the heat roller 72 and the fixing roller 73, and a pressing roller 74 disposed opposite the fixing roller 73 with the fixing belt 71 interposed therebetween. The pressing roller 74 is pressed against the fixing roller 73 via the fixing belt 71. A sheet feeder, not shown, that accommodates and feeds the transfer sheet to the secondary transfer position is disposed in a lower part of the image forming apparatus 10.

The photoconductor 1 is an organic photoconductor having a protective layer formed of polycarbonate resin. The charger 2 includes a charging member, which, in the present illustrative embodiment, is a charging roller 2*a*. The charging roller 2*a* includes a conductive metal core coated with an elastic layer with medium resistance, and is connected to a power source, not shown, by which a predetermined voltage is applied. The charging roller 2*a* and the photoconductor 1 are disposed opposite each other across a minute gap. For example, a spacer member having a certain thickness may be wound around both ends of the charging roller 2*a* in a non-image forming range, so that each spacer member contacts the photoconductor 1 to form the minute gap between the charging roller 2*a* and the photoconductor 1.

The developing device 4 includes a developer bearing member, which, in the present illustrative embodiment, is a developing sleeve 4*a*. The developing sleeve 4*a* has a magnetic field generator therewithin and is disposed opposite the photoconductor 1. Two screws 4*b*, each mixing toner supplied from a toner bottle, not shown, with developer and supplying the developer including the toner and magnetic carrier to the developing sleeve 4*a*, are disposed below the developing sleeve 4*a*. A thickness of the developer thus supplied to the developing sleeve 4*a* is restricted by a doctor blade, not shown, so that the developing sleeve 4*a* bears the developer having a predetermined thickness. The developing sleeve 4*a* bears the developer while rotating in a clockwise direction in FIG. 3 to supply the toner to the electrostatic latent image formed on the photoconductor 1. Although the developing device 4 employs a two-component developing system in the above-described example, the configuration is not limited thereto. Alternatively, the developing device 4 may employ a single-component developing system.

Figure 4:
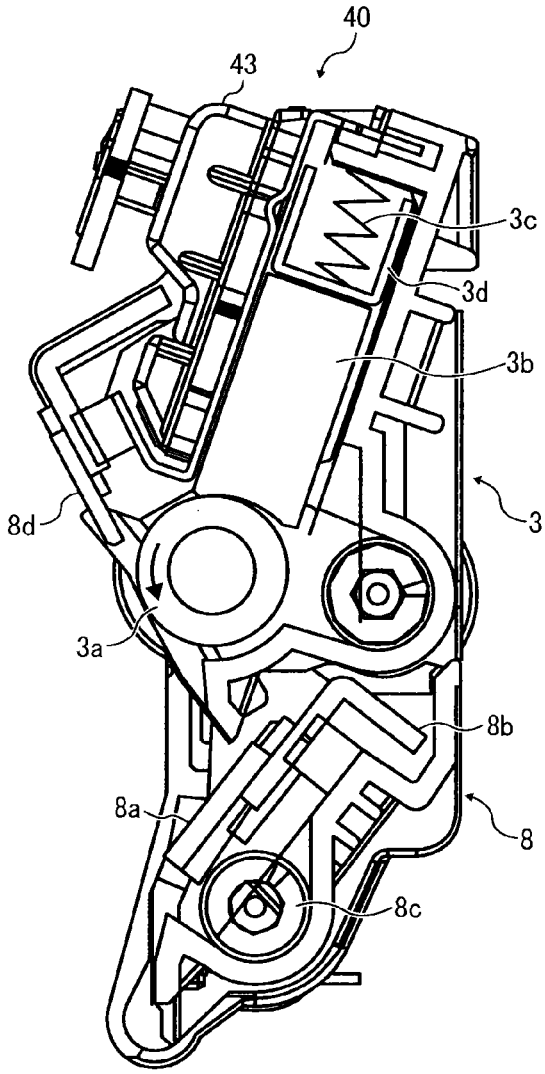
FIG. 4 is a vertical cross-sectional view illustrating an example of a configuration of a unit including a cleaning device and a lubricant applicator.

FIG. 4 is a vertical cross-sectional view illustrating an example of a configuration of a unit that includes the cleaning device 8 and the lubricant applicator 3.

The cleaning device 8 includes a cleaning member, which, in the present illustrative embodiment, is a cleaning blade 8*a*, a support member 8*b*, and a toner collection coil 8*c*. The cleaning blade 8*a* is constructed of a rubber plate formed of urethane rubber, silicone rubber, or the like, and one end of the cleaning blade 8*a* contacts the surface of the photoconductor 1 to remove residual toner from the surface of the photoconductor 1 after the primary transfer of the toner image from the photoconductor 1 onto the intermediate transfer belt 56. The cleaning blade 8*a* is bonded to and supported by the support member 8*b* formed of metal, plastics, ceramics, or the like, and is disposed opposite the photoconductor 1 at a certain angle. It is to be noted that not only the cleaning blade 8*a* but also a well-know cleaning member such as a cleaning brush may be used as the cleaning member of the cleaning device 8.

The lubricant applicator 3 includes a solid lubricant 3*b* accommodated within a stationary casing, and a supply member, which, in the present illustrative embodiment, is an application roller 3*a* that supplies powdered lubricant scraped off from the solid lubricant 3*b* onto the surface of the photoconductor 1. The application roller 3*a* may be constructed of a brush roller, an urethane foam roller, or the like. In a case in which the application roller 3*a* is constructed of a brush roller, it is preferable that the brush roller be formed of a material having a volume resistance of from $1\times10^3$ Ωcm to $1\times10^8$ Ωcm, in which a resistance control material such as carbon black is added to resin such as nylon and acrylic. The application roller 3*a* is rotated counterclockwise in FIGS. 3 and 4. In other words, the application roller 3*a* is rotated in the opposite direction to the direction of rotation of the photoconductor 1 at a contact portion in which the photoconductor 1 and the application roller 3*a* contact each other.

The solid lubricant 3*b* has a square shape and is pressed against the application roller 3*a* by a pressing mechanism 3*c*. The solid lubricant 3*b* includes at least a fatty acid metal salt. Examples of the fatty acid metal salt include, but are not limited to, fluorocarbon resins, lamellar crystallization such as zinc stearate, calcium stearate, barium stearate, aluminum stearate, and magnesium stearate, lauroyl lysine, monocetyl sodium phosphate, and lauroyltaurine calcium. Of these, zinc stearate is most preferable. Zinc stearate spreads well on the surface of the photoconductor 1 and has lower hygroscopicity. In addition, zinc stearate keeps high lubricating property even under changes in humidity. Thus, a protective layer is formed of the lubricant, which has high protecting property and is less affected by environmental changes, on the surface of the photoconductor 1, thereby protecting the surface of the photoconductor 1. In addition, as described previously, the solid lubricant 3*b* keeps high lubricating property against humidity changes, so that cleaning of the surface of the photoconductor 1 is preferably performed. It is to be noted that, alternatively, liquid materials such as silicone oil, fluorocarbon oil, and natural wax, or gaseous materials may be added to the fatty acid metal salt to produce the solid lubricant 3*b*.

It is also preferable that the solid lubricant 3*b* include an inorganic lubricant such as boron nitride. Examples of crystalline structures of boron nitride include, but are not limited to, low-pressure phase hexagonal boron nitride (h-BN) and high-pressure phase cubic boron nitride (c-BN). Of these, low-pressure phase hexagonal boron nitride has a layered structure and is easily cleaved, so that low coefficient of friction at less than 0.2 is kept up to around 400° C. In addition, characteristics of low-pressure phase hexagonal boron nitride are less affected by electrical discharge. Therefore, compared to other materials, low-pressure phase hexagonal boron nitride more reliably keeps lubricating property even when an electrical discharge is applied. Addition of boron nitride to the solid lubricant 3*b* prevents early deterioration of the lubricant supplied to the surface of the photoconductor 1 caused by electrical discharge generated during operation of the charger 2 or the primary transfer rollers 51. Characteristics of boron nitride are not easily changed by the electrical discharge and thus the lubricating property of boron nitride is not lost by the electrical discharge compared to other types of lubricants. Further, boron nitride prevents a photoconductive layer of the photoconductor 1 from being oxidized and volatilized by the electrical discharge. Even a small additive amount of boron nitride provides good lubricating property, thereby effectively preventing chatter of the cleaning blade 8*a* and problems caused by adherence of the lubricant to the charging roller 2*a* or the like.

Materials including zinc stearate and boron nitride are compressed to form the solid lubricant 3*b*. It is to be noted that a method for forming the solid lubricant 3*b* is not limited to the compression process. Alternatively, the solid lubricant 3*b* may be formed by melt process. Thus, the solid lubricant 3*b* has the effects of both zinc stearate and boron nitride.

Although the solid lubricant 3*b* is consumed by being scraped off by the application roller 3*a* and thus a thickness of the solid lubricant 3*b* is reduced over time, the pressing mechanism 3*c* constantly presses the solid lubricant 3*b* against the application roller 3*a*. The application roller 3*a* supplies the lubricant scraped off from the solid lubricant 3*b* to the surface of the photoconductor 1 while rotating. Thereafter, the lubricant supplied to the surface of the photoconductor 1 is spread and leveled by a leveling blade 8*d* that contacts the surface of the photoconductor 1, so that the surface of the photoconductor 1 has a thin layer of the lubricant thereon. As a result, a frictional factor on the surface of the photoconductor 1 is reduced. It is to be noted that the layer of the lubricant adhering to the surface of the photoconductor 1 is too thin to prevent the photoconductor 1 from being charged by the charging roller 2*a*.

In the present illustrative embodiment, the lubricant applicator 3 is disposed downstream from the cleaning device 8 in the direction of rotation of the photoconductor 1. The lubricant supplied to the surface of the photoconductor 1 by the lubricant applicator 3 is spread across the surface of the photoconductor 1 by the leveling blade 8*d* so that the lubricant is roughly leveled on the surface of the photoconductor 1.

A description is now given of a detailed configuration of the lubricant applicator 3 according to a first illustrative embodiment.

Figure 5A:
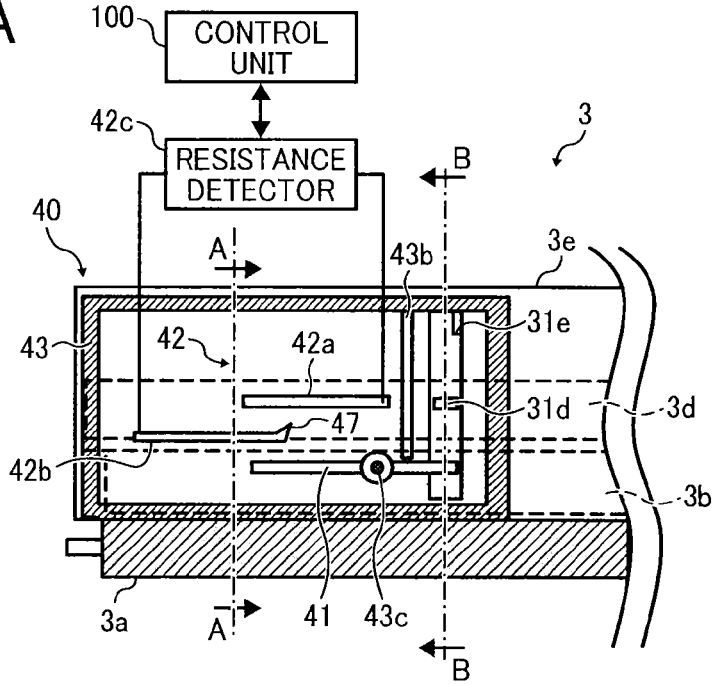
FIG. 5A is a schematic view illustrating an example of a configuration of a lubricant gauge in the early stage of use of a solid lubricant according to a first illustrative embodiment.
Figure 5B:
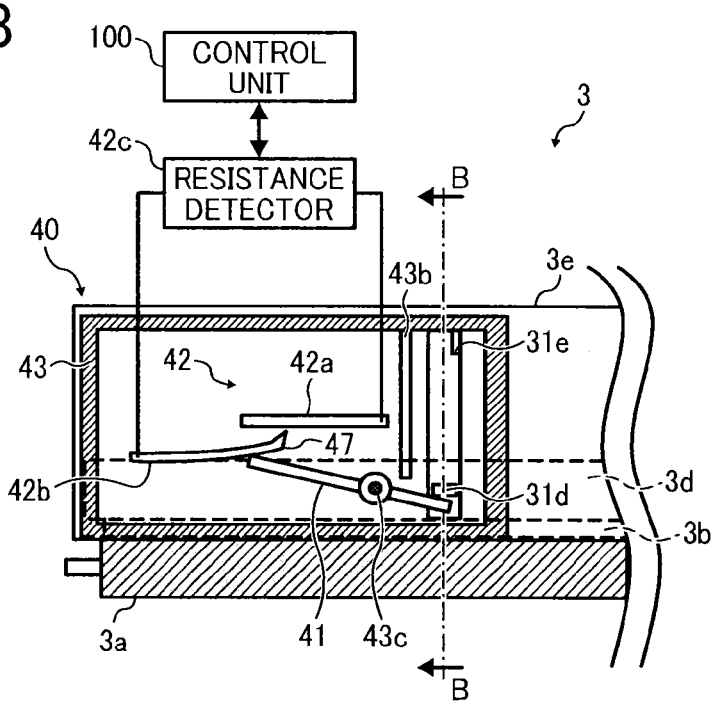
FIG. 5B is a schematic view of the lubricant gauge in a near-end stage of the solid lubricant according to the first illustrative embodiment.
Figure 6:
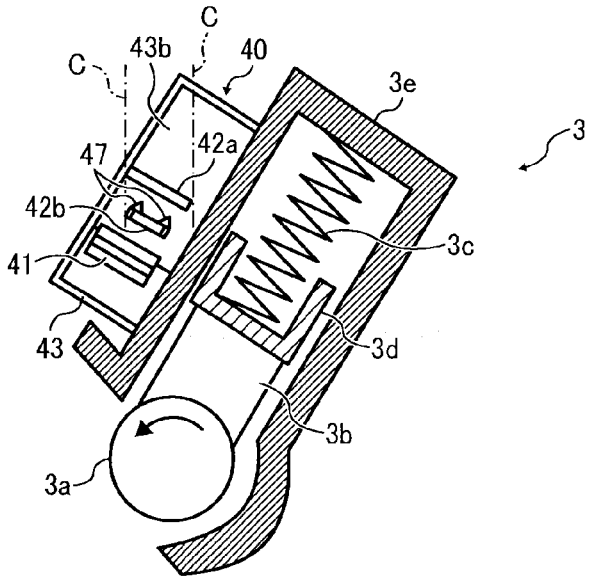
FIG. 6 is a vertical cross-sectional view along line A-A in FIG. 5A.
Figure 7A:
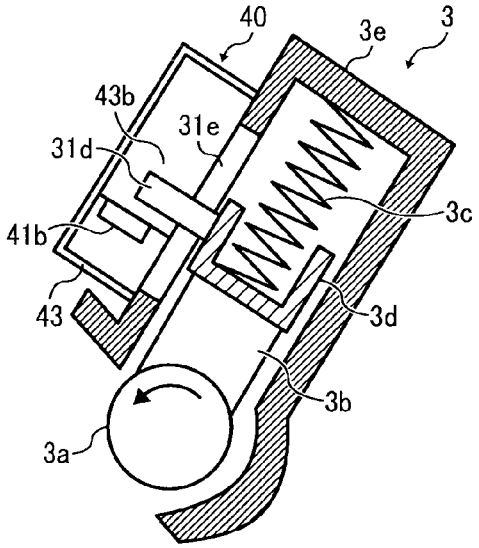
FIG. 7A is a vertical cross-sectional view along line B-B in FIG. 5A.
Figure 7B:
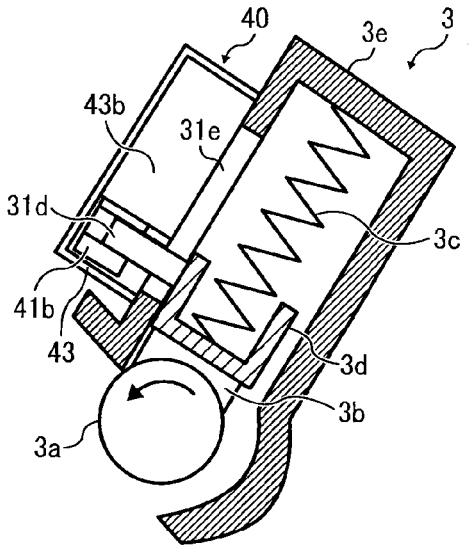
FIG. 7B is a vertical cross-sectional view along line B-B in FIG. 5B.

FIG. 5A is a schematic view illustrating an example of a configuration of a lubricant gauge 40, which is provided to one end of the lubricant applicator 3 in a longitudinal direction thereof, in the early stage of use of the solid lubricant 3*b* according to the first illustrative embodiment. FIG. 5B is a schematic view of the lubricant gauge 40 according to the first illustrative embodiment in a stage of use of the solid lubricant 3*b* in which the solid lubricant 3*b* is almost used up and has only a slight amount remaining (hereinafter referred to as a near-end stage of the solid lubricant 3*b*). FIG. 6 is a vertical cross-sectional view along line A-A in FIG. 5A. FIG. 7A is a vertical cross-sectional view along line B-B in FIG. 5A. FIG. 7B is a vertical cross-sectional view along line B-B in FIG. 5B. It is to be noted that, although only one end of the lubricant applicator 3 is shown in FIGS. 5A and 5B, both ends of the lubricant applicator 3 in the longitudinal direction have the same basic configuration.

The lubricant applicator 3 further includes a lubricant holder 3*d* that holds, across the longitudinal direction, an opposite face of the solid lubricant 3*b* opposite a contact face contacted by the application roller 3*a*. The lubricant holder 3*d* is disposed within a casing 3*e* and is separatably contactable against the application roller 3*a*. The pressing mechanism 3*c*, which, in the present illustrative embodiment, is a pressure spring that presses the solid lubricant 3*b* against the application roller 3*a*, is disposed above the lubricant holder 3*d* within the casing 3*e*. Thus, the solid lubricant 3*b* is pressed against the application roller 3*a* by the pressing mechanism 3*c*.

A remaining amount detector, which, in the present illustrative embodiment, is the lubricant gauge 40, is disposed near both ends of the solid lubricant 3*b* in the longitudinal direction. The lubricant gauge 40 is mounted to a lateral face of the casing 3*e* provided downstream from a contact portion, in which the application roller 3*a* contacts the solid lubricant 3*b*, in a direction of rotation of the application roller 3*a*. The lubricant gauge 40 includes a rotary member 41 and a rotation detector 42 that detects rotation of the rotary member 41. The rotation detector 42 is constructed of a first electrode member 42*a*, a second electrode member 42*b* disposed opposite the first electrode member 42*a*, and a resistance detector 42*c*.

The resistance detector 42*c* is connected to both the first and second electrode members 42*a* and 42*b*, and applies a voltage between the first and second electrode members 42*a* and 42*b* to measure an electrical resistance therebetween. The resistance detector 42*c* is also connected to a control unit 100. The rotary member 41 and the first and second electrode members 42*a* and 42*b* are covered with and supported by a cover member 43. The first and second electrode members 42*a* and 42*b* are disposed above the rotary member 41.

Figure 8:
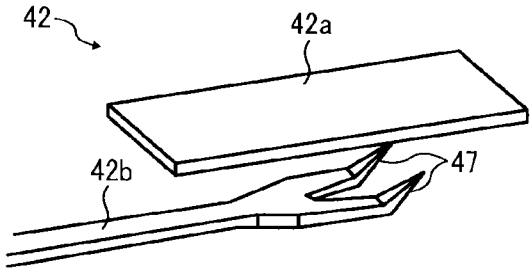
FIG. 8 is an enlarged perspective view illustrating first and second electrode members of a rotation detector included in the lubricant gauge.

FIG. 8 is an enlarged perspective view illustrating the first and second electrode members 42*a* and 42*b* of the rotation detector 42. In the present illustrative embodiment, each of the first and second electrode members 42*a* and 42*b* is constructed of a planar conductive material such as sheet metal. The cover member 43, which is not shown in FIG. 8, holds the right end of the first electrode member 42*a* in FIG. 8. The second electrode member 42*b* is disposed below the first electrode member 42*a* and is narrower than the first electrode member 42*a*. The cover member 43 also holds the left end of the second electrode member 42*b* in FIG. 8. A free end of the second electrode member 42*b*, that is, the right end of the second electrode member 42*b* in FIG. 8, is positioned close and parallel to the first electrode member 42*a*. As shown in FIG. 8, the free end of the second electrode member 42*b* is bifurcated, and a tip of each prong of the second electrode member 42*b* is bent and projects toward the first electrode member 42*a* to form projections 47. Tips of the projections 47 are pointed, so that the projections 47 contact the first electrode member 42*a* at points.

Referring to FIG. 6, a length of the first electrode member 42*a* is longer than a length of the second electrode member 42*b* in a direction perpendicular to the cover member 43, and the size of the first electrode member 42*a* is larger than the size of the second electrode member 42*b* at least at a position around the protrusions 47.

Figure 9:
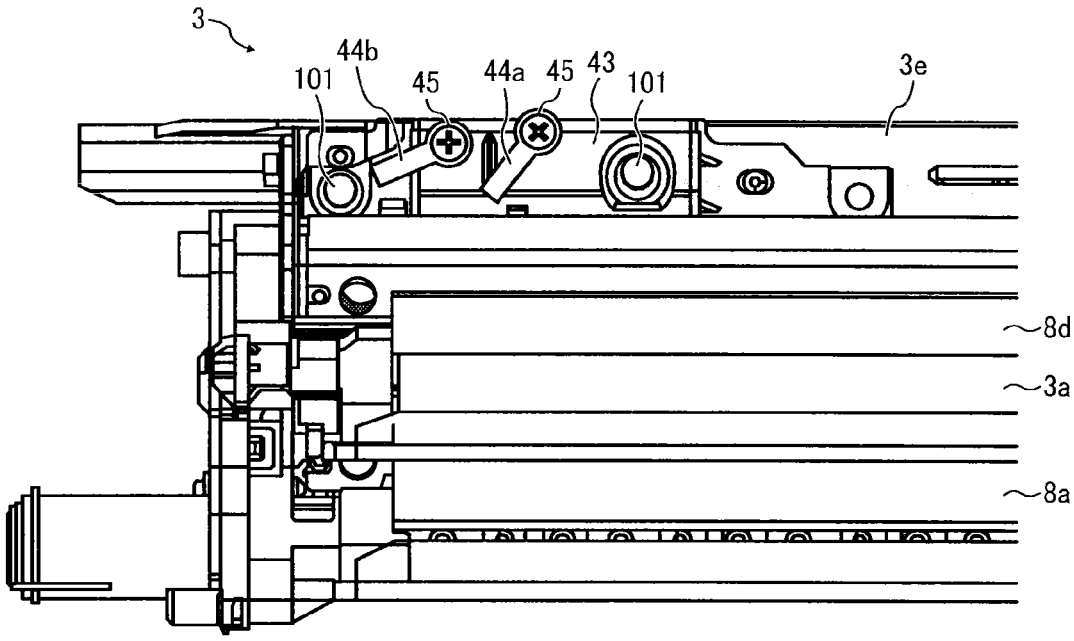
FIG. 9 is a side view illustrating an example of a configuration of one end of the lubricant applicator in a longitudinal direction, viewed from a photoconductor.

FIG. 9 is a side view illustrating an example of a configuration of one end of the lubricant applicator 3 in the longitudinal direction, viewed from the photoconductor 1.

The cover member 43 is fixed to the casing 3*e* with screws 101. A first terminal 44*a* electrically connected to the first electrode member 42*a* and a second terminal 44*b* electrically connected to the second electrode member 42*b* are fixed to the cover member 43 with screws 45. The resistance detector 42*c* is connected to the first and second terminals 44*a* and 44*b*.

An opening 31*e* extending in a direction of movement of the lubricant holder 3*d* is formed in the lateral face of the casing 3*e* provided downstream from the contact portion in which the application roller 3*a* contacts the solid lubricant 3*b*. The opening 31*e* is offset from the ends of the solid lubricant 3*b* by a predetermined distance toward the center of the solid lubricant 3*b* in the longitudinal direction. A pressing member 31*d* provided to the lubricant holder 3*d* penetrates through the opening 31*e*. The cover member 43 includes a partition wall 43*b* that divides an internal space encompassed by the cover member 43 into two parts, that is, a first part within which the opening 31*e* is provided and a second part within which the first and second electrode members 42*a* and 42*b* are disposed.

The rotary member 41 has a planar shape and is rotatably supported on a rotary shaft 43*c* provided to the cover member 43. The right end of the rotary member 41 in FIGS. 5A and 5B is positioned opposite the pressing member 31*d*. The left end of the rotary member 41 in FIGS. 5A and 5B is positioned opposite the second electrode member 42*b*. A length of the rotary member 41 from a pivot, that is, the rotary shaft 43*c*, to the left end is longer than a length of the rotary member 41 from the pivot to the right end, so that the left part of the rotary member 41 from the pivot is heavier than the right part of the rotary member 41. Accordingly, the rotary member 41 is rotatable counterclockwise in FIGS. 5A and 5B by gravity. When the pressing member 31*d* provided to the lubricant holder 3*d* is positioned away from the rotary member 41 as illustrated in FIG. 5A in the early stage of use of the solid lubricant 3*b*, the rotary member 41 abuts the end of the partition wall 43*b* so that counterclockwise rotation of the rotary member 41 by gravity is restricted by the partition wall 43*b*.

At this time, the left end of the rotary member 41 is positioned away from the second electrode member 42*b*, which is positioned opposite the first electrode member 42*a* across a predetermined gap. Accordingly, no electric current flows between the first and second electrode members 42*a* and 42*b* even when the resistance detector 42*c* applies a voltage between the first and second electrode members 42*a* and 42*b*, and thus the resistance detector 42*c* does not measure an electrical resistance.

As the solid lubricant 3*b* is gradually scraped off by the application roller 3*a* and is reduced over time, the lubricant holder 3*d* is moved downward to the application roller 3*a*. Then, as the solid lubricant 3*b* is consumed, the pressing member 31*d* provided to the lubricant holder 3*d* contacts the rotary member 41. When the solid lubricant 3*b* is further scraped off by the application roller 3*a* and thus is further reduced, the right end of the rotary member 41 in FIGS. 5A and 5B is pressed by the pressing member 31*d* so that the rotary member 41 is rotated clockwise, which is opposite a direction in which the rotary member 41 is rotated by gravity. The rotary member 41 is further rotated clockwise as the solid lubricant 3*b* is further scraped off and reduced, so that the left end of the rotary member 41 contacts the second electrode member 42*b*. Thereafter, when the solid lubricant 3*b* is further scraped off and the rotary member 41 is further rotated clockwise, the rotary member 41 presses the free end of the second electrode member 42*b*, that is, the right end of the second electrode member 42*b*, toward the first electrode member 42*a* as illustrated in FIG. 5B. As a result, the free end of the second electrode member 42*b* approaches the first electrode member 42*a*. When the solid lubricant 3*b* reaches the near-end stage, the rotary member 41 is rotated at a predetermined angle so that the projections 47 of the second electrode member 42*b* contact the first electrode member 42*a*. Accordingly, electrical continuity is established between the first and second electrode members 42*a* and 42*b*. Thus, application of a voltage between the first and second electrode members 42*a* and 42*b* by the resistance detector 42*c* generates an electric current between the first and second electrode members 42*a* and 42*b*. As a result, the resistance detector 42*c* measures an electrical resistance so that rotation of the rotary member 41 by consumption of the solid lubricant 3*b* is detected.

The control unit 100 monitors the readings taken by the resistance detector 42*c*. When the electrical resistance thus measured by the resistance detector 42*c* is less than a threshold value, the control unit 100 determines that the solid lubricant 3*b* reaches the near-end stage. Then, the control unit 100 reports to an operating unit, not shown, that the solid lubricant 3*b* is almost used up to prompt a user to replace the solid lubricant 3*b* with a new solid lubricant. Alternatively, a communication unit, not shown, may be used to notify a service center of replacement for the solid lubricant 3*b*.

The amount of the lubricant supplied to the photoconductor 1 is not constant but varies depending on an area ratio of an image formed on the surface of the photoconductor 1. Specifically, upon the primary transfer of the toner image onto the intermediate transfer belt 56 from the surface of the photoconductor 1, onto which the lubricant is supplied by the lubricant applicator 3, such lubricant may be also transferred onto the intermediate transfer belt 56, together with the toner image, from the surface of the photoconductor 1. Thus, compared to the surface of the photoconductor 1 onto which a toner image with a lower area ratio is formed, the surface of the photoconductor 1 onto which a toner image with a higher area ratio is formed has a smaller amount of lubricant thereon after the primary transfer of the toner image from the surface of the photoconductor 1 onto the intermediate transfer belt 56. As a result, a larger amount of lubricant is supplied to the surface of the photoconductor 1, onto which the toner image with a higher area ratio is formed. For these reasons, consumption of the solid lubricant 3*b* differs between a case in which the image with a lower area ratio such as a letter is often formed and a case in which the image with a higher area ratio such as a photograph is often formed.

Therefore, unlike the present illustrative embodiment, if the near-end stage of the solid lubricant 3*b* is determined only by an operating time such as a cumulative distance traveled by the application roller 3*a*, accurate detection of the near-end stage of the solid lubricant 3*b* under all usage conditions is not possible. For example, in a case in which the near-end stage of the solid lubricant 3*b* is determined by a cumulative distance traveled by the application roller 3*a* for a usage condition in which the solid lubricant 3*b* is heavily consumed, replacement of the solid lubricant 3*b*, which is not used up yet under a usage condition in which the solid lubricant 3*b* is less consumed, may be prompted. Conversely, in a case in which the near-end stage of the solid lubricant 3*b* is determined by a cumulative distance traveled by the application roller 3*a* for the usage condition in which the solid lubricant 3*b* is less consumed, the sold lubricant 3*b* may be used up before the detection of the near-end stage under the usage condition in which the solid lubricant 3*b* is heavily consumed.

By contrast, in the present illustrative embodiment, the near-end stage of the solid lubricant 3*b* is detected by the lubricant gauges 40 based on the height of the solid lubricant 3*b*. As a result, the near-end stage of the solid lubricant 3*b* is more accurately detected, regardless of the usage conditions, compared to the configuration in which the cumulative distance traveled by the application roller 3*a* is used for determining the near-end stage of the solid lubricant 3*b*.

In addition, in the present illustrative embodiment, electrical continuity (an electrical circuit) between the first and second electrode members 42*a* and 42*b* is not established until the rotary member 41 is moved to the position to detect the near-end stage of the solid lubricant 3*b*. Therefore, no electric current flows between the first and second electrode members 42*a* and 42*b* in such a state even when a voltage is applied between the first and second electrode members 42*a* and 42*b*. As a result, electric power is not consumed each time the detection of the near-end stage of the solid lubricant 3*b* is performed, thereby reducing power consumption. In addition, in the present illustrative embodiment, the first and second electrode members 42*a* and 42*b* are formed of a relatively inexpensive material such as sheet metal. Thus, the rotation detector 42 is provided at reduced cost.

As described previously, the lubricant gauge 40 is disposed near both ends of the solid lubricant 3*b* in the longitudinal direction. Therefore, even when the solid lubricant 3*b* is consumed at different rates at both ends thereof in the longitudinal direction, upon reaching the near-end stage at one end of the solid lubricant 3*b*, the rotary member 41 included in the lubricant gauge 40 provided near that end is rotated so that the second electrode member 42*b* contacts the first electrode member 42*a* to establish electrical continuity therebetween. Thus, even when the solid lubricant 3*b* is consumed at different rates at both ends thereof in the longitudinal direction, the near-end stage of the solid lubricant 3*b* at either end thereof is accurately detected, thereby preventing damage to the surface of the photoconductor 1 due to insufficient supply of the lubricant to the surface of the photoconductor 1.

Further, in the present illustrative embodiment, the lubricant gauge 40 is disposed outside the casing 3*e*. Thus, adherence of scattered powdered lubricant to the first and second electrode members 42*a* and 42*b* is also prevented.

As described previously, upon the primary transfer of the toner image, the lubricant supplied to the surface of the photoconductor 1, particularly at a central part of the surface of the photoconductor 1, tends to be transferred onto the intermediate transfer belt 56, together with the toner image, from the surface of the photoconductor 1. Therefore, the lubricant supplied to the central part of the surface of the photoconductor 1 tends to be consumed heavily. Meanwhile, because both ends on the surface of the photoconductor 1 generally correspond to margins of a sheet, a toner image is rarely formed on the ends on the surface of the photoconductor 1. Therefore, the lubricant supplied to the ends on the surface of the photoconductor 1 tends to be less consumed. As a result, an amount of lubricant supplied to the surface of the photoconductor 1 from both ends of the solid lubricant 3*b* in the longitudinal direction is smaller than an amount of lubricant supplied from a central part of the solid lubricant 3*b* in the longitudinal direction. However, the amount of lubricant scraped off by the application roller 3*a* is substantially even across the longitudinal direction of the solid lubricant 3*b*. Consequently, an amount of lubricant remaining on the application roller 3*a* without being supplied to the surface of the photoconductor 1 is larger at both ends of the application roller 3*a* compared to a central part of the application roller 3*a* in the longitudinal direction. The lubricant remaining on the application roller 3*a* falls and accumulates within the casing 3*e*. For the above-described reasons, a larger amount of lubricant accumulates at both ends of the casing 3*e* in the longitudinal direction compared to a central part of the casing 3*e*. Unlike the present illustrative embodiment, if the opening 31*e* is provided near the ends of the casing 3*e* in the longitudinal direction, a larger amount of lubricant accumulating at the ends of the casing 3*e* scatters outside through the opening 31*e*. Consequently, a larger amount of lubricant may adhere to the first or second electrode member 42*a* or 42*b* and such lubricant may cause irregular electrical continuity between the first and second electrode members 42*a* and 42*b*, resulting in erroneous detection of the near-end stage of the solid lubricant 3*b*. By contrast, in the present illustrative embodiment, the opening 31*e* is positioned offset from the ends of the casing 3*e* towards the center by a predetermined distance in the longitudinal direction of the solid lubricant 3*b*. Accordingly, the amount of lubricant scattered through the opening 31*e* is reduced compared to the case in which the opening 31*e* is provided at the ends of the casing 3*e*. As a result, adherence of powdered lubricant scattered through the opening 31*e* to the first or second electrode member 42*a* or 42*b* is prevented, thereby preventing irregular electrical continuity between the first and second electrode members 42*a* and 42*b*. Thus, the near-end stage of the solid lubricant 3*b* is accurately detected. It is preferable that the size of the opening 31*e* be as small as possible in order to prevent scattering of powdered lubricant through the opening 31*e*.

In the present illustrative embodiment, the rotary member 41 is pressed by the pressing member 31*d* to press the second electrode member 42*b* against the first electrode member 42*a*. Accordingly, a contact part in which the first and second electrode members 42*a* and 42*b* contact each other is positioned away from the opening 31*e*. As a result, adherence of lubricant scattered through the opening 31*e* to the first and second electrode members 42*a* and 42*b* is further prevented.

In addition, in the present illustrative embodiment, the lubricant holder 3*d* is configured to move downward as the solid lubricant 3*b* is consumed, so that the right end of the rotary member 41 in FIGS. 5A and 5B is moved downward by the pressing member 31*d* of the lubricant holder 3*d*, and therefore, the left end of the rotary member 41 positioned opposite the second electrode member 42*b* is moved upward. Such a configuration allows the first and second electrode members 42*a* and 42*b* to position above the contact portion in which the application roller 3*a* contacts the solid lubricant 3*b*, thereby preventing adherence of lubricant scraped off by the application roller 3*a* to the first and second electrode members 42*a* and 42*b*.

Further, in the present illustrative embodiment, the first and second electrode members 42*a* and 42*b* are vertically aligned to face each other.

Because an upper surface of the second electrode member 42*b* contacts the first electrode member 42*a*, it is necessary to prevent adherence of lubricant to the upper surface of the second electrode member 42*b*. For this reason, the right end of the second electrode member 42*b* in FIGS. 5A and 5B, which contacts the first electrode member 42*a*, is positioned closer to the first electrode member 42*a*. As a result, a gap between the right end of the second electrode member 42*b* and the first electrode member 42*a* is reduced, thereby preventing adherence of lubricant to the upper surface of the right end of the second electrode member 42*b*.

For a fuller appreciation of the non-predictable effects achieved by the above-described embodiment, a description is now given of a related-art lubricant gauge as a comparative example of the present illustrative embodiment.

Figure 10:
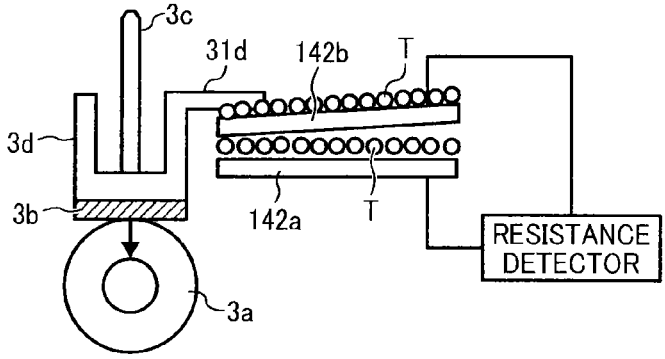
FIG. 10 RELATED ART
FIG. 10 is a schematic view illustrating an example of a configuration of a related-art lubricant gauge.
Figure 11:
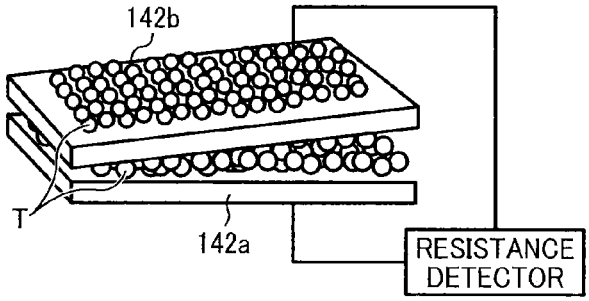
FIG. 11 RELATED ART
FIG. 11 is a schematic view of the related-art lubricant gauge illustrated in FIG. 10 in the near-end stage.

FIG. 10 is a schematic view illustrating an example of a configuration of a related-art lubricant gauge. As shown in FIG. 10, in the related-art lubricant gauge, a planar second electrode member 142*b* is disposed above a planar first electrode member 142*a*. A lower surface of the second electrode member 142*b* contacts an upper surface of the first electrode member 142*a* to detect the near-end stage of the solid lubricant 3*b*. In the above configuration in which the two planar electrode members 142*a* and 142*b* are vertically aligned to face each other, scattered lubricant T or the like may accumulate on upper surfaces of the first and second electrode members 142*a* and 142*b*. When the pressing member 31*d* presses the second electrode member 142*b* against the first electrode member 142*a* so that a lower surface of the second electrode member 142*b* contacts the upper surface of the first electrode member 142*a*, the lubricant T accumulating on the upper surface of the first electrode member 142*a* may hinder contact of the second electrode member 142*b* with the first electrode member 142*a* as illustrated in FIG. 11.

By contrast, in the present illustrative embodiment, the projections 47 projecting toward the first electrode member 42*a* are provided at the free end of the second electrode member 42*b* disposed below the first electrode member 42*a*, so that the projections 47 contact the first electrode member 42*a* at points. Thus, the projections 47 that contact the first electrode member 42*a* project upward toward the first electrode member 42*a* from the upper surface of the second electrode member 42*b*, thereby preventing accumulation of lubricant T on the projections 47. As a result, the second electrode member 42*b* reliably contacts the first electrode member 42*a* when the solid lubricant 3*b* reaches the near-end stage, thereby accurately detecting the near-end stage of the solid lubricant 3*b*.

In addition, the tip of each projection 47 is pointed, thereby further preventing accumulation of lubricant Ton the tips of the projections 47. As a result, the second electrode member 42*b* reliably contacts the first electrode member 42*a* when the solid lubricant 3*b* reaches the near-end stage, thereby accurately detecting the near-end stage of the solid lubricant 3*b*.

Even in a case in which the lubricant T adheres to a part of the lower surface of the first electrode member 42*a*, which is contacted by the second electrode member 42*b*, such lubricant T is easily removed from the first electrode member 42*a* by the projections 47 of the second electrode member 42*b* compared to the related-art lubricant gauge in which the two planar electrode members 142*a* and 142*b* contact each other.

In the related-art lubricant gauge illustrated in FIGS. 10 and 11, the first and second electrode members 142*a* and 142*b* contact each other across a relatively large area. Consequently, there is no space to which the lubricant T adhering to either the first or second electrode member 142*a* or 142*b* moves from a contact part in which the first and second electrode members 142*a* and 142*b* contact each other. In addition, because an area of the contact part is relatively large as described above, the first and second electrode members 142*a* and 142*b* contact each other with a lower contact pressure, which is not enough to move the lubricant T adhering to either the first or second electrode member 142*a* or 142*b* from the contact part of the first and second electrode members 142*a* and 142*b*. By contrast, in the present illustrative embodiment, there is enough space around the projections 47 so that the projections 47 move the lubricant T from the contact part to that space when contacting the first electrode member 42*a*. Further, the projections 47 of the second electrode member 42*b* contact the first electrode member 42*a* with a larger contact pressure, thereby reliably moving the lubricant T adhering to the first electrode member 42*a* from the contact part. As a result, even in a case in which the lubricant T adheres to a part of the lower surface of the first electrode member 42*a*, which is contacted by the second electrode member 42*b*, such lubricant T is easily removed from that part by the projections 47 of the second electrode member 42*b*. Thus, the second electrode member 42*b* reliably contacts the first electrode member 42*a* when the solid lubricant 3*b* reaches the near-end stage, thereby accurately detecting the near-end stage of the solid lubricant 3*b*.

In the present illustrative embodiment, the free end of the second electrode member 42*b* having the projections 47 does not move upward parallel to the first electrode member 42*a*, but moves toward the first electrode member 42*a* in an arc-shaped path with the fixed end of the second electrode member 42*b* as a pivot. Accordingly, the projections 47 provided to the free end of the second electrode member 42*b* is slightly moved also in a direction parallel to the lower surface of the first electrode member 42*a* when contacting the first electrode member 42*a*. As a result, the lubricant or the like adhering to the lower surface of the first electrode member 42*a* is scraped off by the projections 47.

In the present illustrative embodiment, the free end of the second electrode member 42*b* is bifurcated to form the projections 47 at the tip of each prong, so that the two projections 47 contact the first electrode member 42*a*. Such a configuration allows one of the projections 47 to still reliably contact the first electrode member 42*a* even when the other one of the projections 47 does not properly contact the first electrode member 42*a* for some reasons. Thus, the second electrode member 42*b* reliably contacts the first electrode member 42*a* when the solid lubricant 3*b* reaches the near-end stage, thereby accurately detecting the near-end stage of the solid lubricant 3*b*.

Although the projections 47 are provided to the second electrode member 42*b* disposed below the first electrode member 42*a* in the present illustrative embodiment, alternatively, in place of the second electrode member 42*b*, the first electrode member 42*a* disposed above the second electrode member 42*b* may have the projections 47. In such a case, the projections 47 provided to the first electrode member 42*a* contact the upper surface of the second electrode member 42*b*. As described previously, even in a case in which the lubricant adheres to a part of the upper surface of the second electrode member 42*b*, which contacts the first electrode member 42*a*, such lubricant is easily removed from the second electrode member 42*b* by the projections 47 of the first electrode member 42*a*, so that the projections 47 reliably contact the second electrode member 42*b*.

Figure 12:
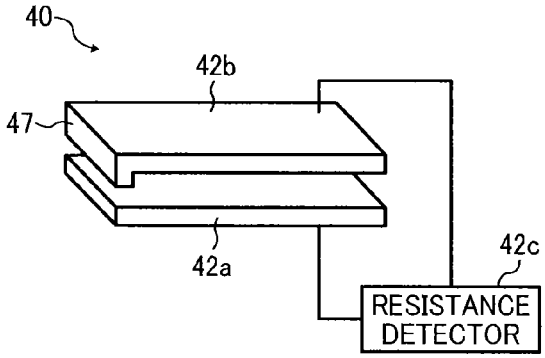
FIG. 12 is a schematic view illustrating an example of a configuration of a projection provided to the second electrode member according to a first variation.
Figure 13:
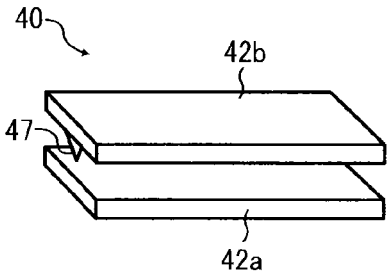
FIG. 13 is a schematic view illustrating an example of a configuration of a projection provided to the second electrode member according to a second variation.
Figure 14:
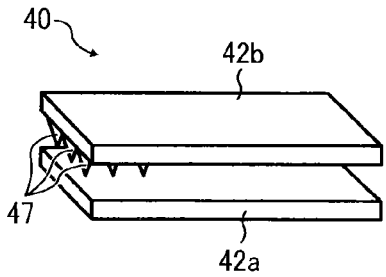
FIG. 14 is a schematic view illustrating an example of a configuration of a projection provided to the second electrode member according to a third variation.
Figure 15:
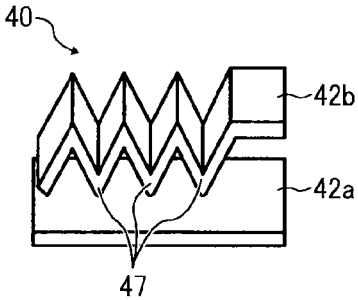
FIG. 15 is a schematic view illustrating an example of a configuration of a projection provided to the second electrode member according to a fourth variation.
Figure 16:
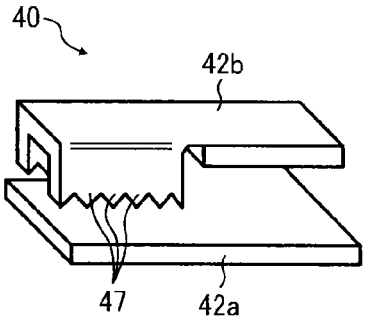
FIG. 16 is a schematic view illustrating an example of a configuration of a projection provided to the second electrode member according to a fifth variation.

Alternatively, as illustrated in FIG. 12, the second electrode member 42*b* may have a planar shape with a free end bent toward the first electrode member 42*a* as the projection 47. Further alternatively, a single pointed projection 47 may be provided to the planar second electrode member 42*b* as illustrated in FIG. 13, or three or more pointed projections 47 may be provided to the planar second electrode member 42*b* as illustrated in FIG. 14. Still further alternatively, the free end of the second electrode member 42*b* may be saw-shaped to form multiple projections 47 as illustrated in FIG. 15. Yet further alternatively, both lateral edges at the free end of the second electrode member 42*b* are bent toward the first electrode member 42*a*, and a tip of each bent edge may be saw-shaped to form multiple projections 47 as illustrated in FIG. 16. It is to be noted that, for ease of illustration, the second electrode member 42*b* is positioned above the first electrode member 42*a* in FIGS. 12 to 16.

Figure 17:
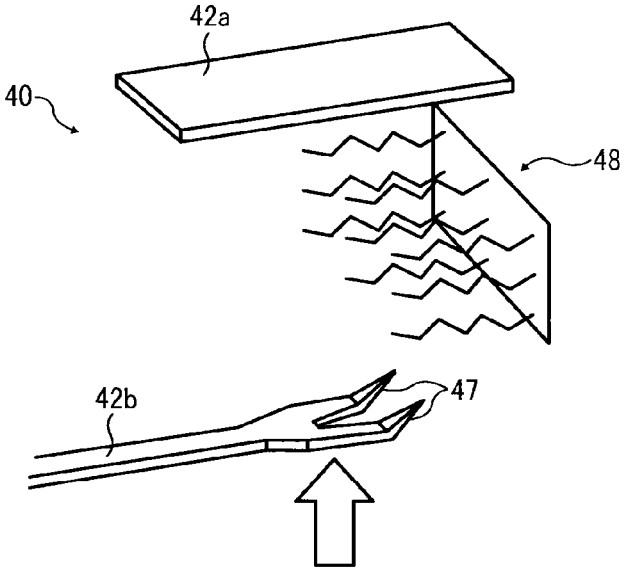
FIG. 17 is an enlarged perspective view illustrating an example of a configuration of a lubricant gauge according to a second illustrative embodiment.

FIG. 17 is an enlarged perspective view illustrating an example of a configuration of the lubricant gauge 40 according to a second illustrative embodiment. In the second illustrative embodiment, a cleaner such as a cleaning brush 48 that cleans the projections 47 is disposed between the first and second electrode members 42*a* and 42*b* within a range in which the projections 47 move. When moving toward the first electrode member 42*a*, the projections 47 are rubbed by bristles of the cleaning brush 48 so that lubricant or the like adhering to the projections 47 is removed by the cleaning brush 48. As a result, the second electrode member 42*b* reliably contacts the first electrode member 42*a* when the solid lubricant 3*b* reaches the near-end stage, thereby allowing accurate detection of the near-end stage of the solid lubricant 3*b*.

In the above configuration illustrated in FIG. 17, it is preferable that the second electrode member 42*b* having the projections 47 be provided below the first electrode member 42*a*. Assuming that the second electrode member 42*b* is disposed above the first electrode member 42*a*, lubricant or the like removed from the projections 47 of the second electrode member 42*b* by the cleaning brush 48 may fall and adhere to the upper surface of the first electrode member 42*a*, which is contacted by the projections 47. By contrast, when the second electrode member 42*b* having the projections 47 is disposed below the first electrode member 42*a*, lubricant or the like removed from the projections 47 by the cleaning brush 48 does not adhere to the lower surface of the first electrode member 42*a*, which is contacted by the projections 47. As a result, contamination of a contact surface of the first electrode member 42*a* contacted by the projections 47 of the second electrode member 42*b* is prevented, thereby reliably contacting the first and second electrode members 42*a* and 42*b*.

In the foregoing illustrative embodiments, an area of the first electrode member 42*a* projected from above onto a horizontal plane (hereinafter referred to as a horizontal projection area) is larger than a horizontal projection area of the free end of the second electrode member 42*b* having the projections 47. Accordingly, when viewed from above as indicated by broken lines C in FIG. 6, the free end of the second electrode member 42*b* is hidden by the first electrode member 42*a*. In other words, the first electrode member 42*a* functions as a canopy so that the lubricant or the like falling from above is caught by the upper surface of the first electrode member 42*a* and does not fall on the second electrode member 42*b*. As a result, adherence of lubricant to the upper surface of the second electrode member 42*b* is prevented. It is to be noted that accumulation of lubricant on the upper surface of the first electrode member 42*a* does not adversely affect establishment of electrical continuity between the first and second electrode members 42*a* and 42*b*.

Figure 18:
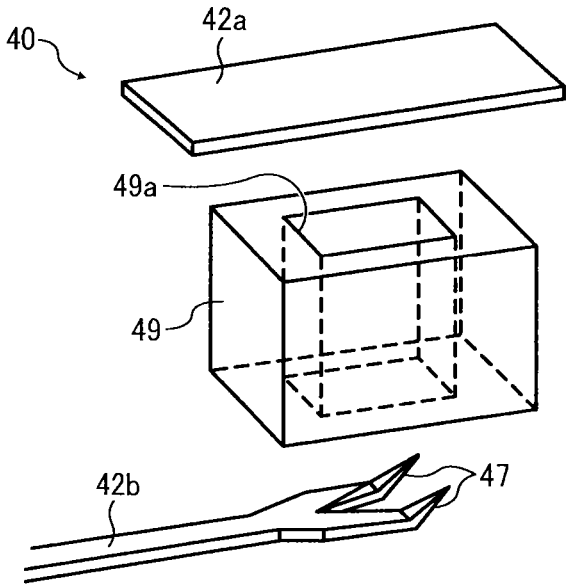
FIG. 18 is an exploded perspective view illustrating an example of a configuration of a lubricant gauge according to a third illustrative embodiment.
Figure 19:
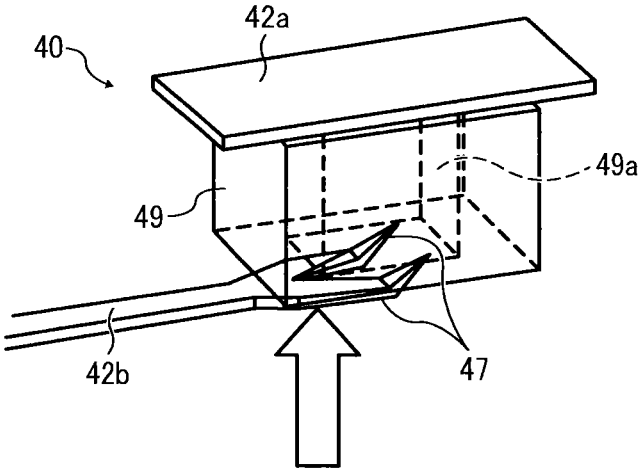
FIG. 19 is an enlarged perspective view of the lubricant gauge illustrated in FIG. 18 in a state in which the second electrode member is moved toward the first electrode member.

A description is now given of an example of a configuration of the lubricant gauge 40 according to a third illustrative embodiment, with reference to FIGS. 18 and 19. FIG. 18 is an exploded perspective view illustrating an example of a configuration of the lubricant gauge 40 according to the third illustrative embodiment. FIG. 19 is an enlarged perspective view of the lubricant gauge 40 illustrated in FIG. 18 in a state in which the second electrode member 42*b* is moved toward the first electrode member 42*a*. In the third illustrative embodiment, a shield member 49 that encompasses and shields the projections 47 is further provided to prevent adherence of lubricant to the projections 47 and the contact part of the first electrode member 42*a* contacted by the projections 47.

The shield member 49 is formed of a deformable insulating material such as sponge and has a through-hole 49*a* at the center thereof. An upper surface of the shield member 49 is fixed to the lower surface of the first electrode member 42*a* with an adhesive tape or the like as illustrated in FIG. 19. The shield member 49 is disposed such that the projections 47 of the second electrode member 42*b* enter the through-hole 49*a* when the second electrode member 42*b* is moved toward the first electrode member 42*a*.

When being pressed against the first electrode member 42*a* by the rotary member 41 as the solid lubricant 3*b* is consumed, the second electrode member 42*b* is moved toward the first electrode member 42*a* while squashing the shield member 49. Accordingly, the projections 47 of the second electrode member 42*b*, which are disposed to enter the through-hole 49*a* of the shield member 49, contact the first electrode member 42*a*. At this time, resilience of the shield member 49 that moves the projections 47 away from the first electrode member 42*a* acts on the second electrode member 42*b*. However, in the present illustrative embodiment, the first and second electrode members 42*a* and 42*b* have sufficient strength compared to the strength of the shield member 49, thereby preventing the projections 47 of the second electrode member 42*b* from separating from the first electrode member 42*a* by the resilience of the shield member 49. As a result, the projections 47 of the second electrode member 42*b* reliably contact the first electrode member 42*a* when the solid lubricant 3*b* reaches the near-end stage, thereby accurately detecting the near-end stage of the solid lubricant 3*b*. An amount of projection of each projection 47 from the second electrode member 42*b* is set based on a thickness of the shield member 49 after deformation, such that the projections 47 reliably contact the first electrode member 42*a*.

The shield member 49 prevents adherence of lubricant or the like to the projections 47 and the contact part of the first electrode member 42*a* contacted by the projections 47, thereby preventing erroneous detection of the near-end stage of the lubricant 3*b*.

In the foregoing illustrative embodiments, as described previously, the partition wall 43*b* included in the cover member 43 divides the internal space encompassed by the cover member 43 into the first part, within which the opening 31*e* is provided, and the second part, within which the first and second electrode members 42*a* and 42*b* are disposed. As a result, even when the powdered lubricant enters the internal space via the opening 31*e*, adherence of the powdered lubricant to the first and second electrode members 42*a* and 42*b* is further prevented by the partition wall 43*b*. It is preferable that the cover member 43 and the partition wall 43*b* be formed together of resin as a single integrated component. Thus, compared to a configuration in which the cover member 43 and the partition wall 43*b* are individually provided, the number of components is reduced, thereby reducing production cost. Alternatively, the partition wall 43*b* may be provided to the casing 3*e*. In such a case, it is preferable that the casing 3*e* and the partition wall 43*b* be formed together of resin as a single integrated component, so that the number of components is reduced, thereby reducing production cost. Further alternatively, both the cover member 43 and the casing 3*e* may have a partition wall, and combined together so that the internal space encompassed by the cover member 43 is divided into the first part, within which the opening 31*e* is provided, and the second part, within which the first and second electrode members 42*a* and 42*b* are disposed.

In the foregoing illustrative embodiments, the opening 31*e* and the first and second electrode members 42*a* and 42*b* are covered with the cover member 43. Accordingly, the powdered lubricant is prevented from scattering outside the lubricant applicator 3 via the opening 31*e*, thereby preventing the interior of the image forming apparatus 10 from getting contaminated. In addition, adherence of the scattered toner to the first and second electrode members 42*a* and 42*b* is prevented, thereby preventing irregular electrical continuity between the first and second electrode members 42*a* and 42*b*.

In the foregoing illustrative embodiments, a direction in which the rotary member 41 is rotated by gravity is opposite to a direction in which the rotary member 41 is rotated as the solid lubricant 3*b* is consumed. Unlike the foregoing illustrative embodiments, if the rotary member 41 is configured to rotate in the same direction either by gravity or consumption of the solid lubricant 3*b*, a restriction member constructed of a biasing member such as a spring is further provided to bias the rotary member 41 toward the direction opposite to the direction in which the rotary member 41 is rotated by gravity, such that the rotary member 41 is prevented from being rotated by gravity. In such a configuration, a biasing force of the spring is increased when the pressing member 31*d* of the lubricant holder 3*d* presses against the rotary member 41 to rotate the rotary member 41 as the solid lubricant 3*b* is consumed. Consequently, as the solid lubricant 3*b* approaches the near-end stage, the contact pressure of the solid lubricant 3*b* against the application roller 3*a* is reduced, thereby reducing the amount of lubricant supplied to the surface of the photoconductor 1.

By contrast, in the foregoing illustrative embodiments, the direction in which the rotary member 41 is rotated by gravity is opposite to the direction in which the rotary member 41 is rotated as the solid lubricant 3*b* is consumed, thereby eliminating provision of the spring described above. Thus, the contact pressure of the solid lubricant 3*b* against the application roller 3*a* is kept constant. As a result, a fluctuation in the amount of lubricant supplied to the surface of the photoconductor 1 is suppressed compared to the case in which the rotary member 41 is rotated in the same direction either by gravity or consumption of the solid lubricant 3*b*.

In the foregoing illustrative embodiments, the cover member 43 holds the first and second electrode members 42*a* and 42*b* and the rotary member 41. Because the first and second electrode members 42*a* and 42*b* and the rotary member 41 are supported by the same member, that is, the cover member 43, accumulation of tolerances is minimized. Accordingly, the first and second electrode members 42*a* and 42*b* and the rotary member 41 are accurately positioned relative to one another. As a result, the second electrode member 42*b* reliably contacts the first electrode member 42*a* when the solid lubricant 3*b* reaches the near-end stage, thereby accurately detecting the near-end stage of the solid lubricant 3*b*. In addition, the lubricant gauge 40 is easily detached from the lubricant applicator 3 by simply removing the cover member 43 from the casing 3*e*, thereby facilitating replacement of the lubricant gauge 40.

In the foregoing illustrative embodiments, the application roller 3*a* scrapes off the solid lubricant 3*b* to supply the lubricant to the surface of the photoconductor 1 while rotating. Therefore, during the application of the lubricant to the surface of the photoconductor 1 by the application roller 3*a*, the solid lubricant 3*b* receives a force in a direction of rotation of the application roller 3*a*, that is, a leftward force in FIGS. 7A and 7B. The lubricant holder 3*d* is configured to be movable within the casing 3*e*. In other words, the lubricant holder 3*d* is accommodated within the casing 3*e* with play. Such a configuration moves the lubricant holder 3*d*, which holds the solid lubricant 3*b*, in a direction in which the application roller 3*a* scrapes off the solid lubricant 3*b*, that is, leftward in FIGS. 7A and 7B, when the solid lubricant 3*b* receives the force in the direction of rotation of the application roller 3*a*. Unlike the foregoing illustrative embodiments, if the lubricant gauge 40 is mounted to a lateral face of the casing 3*e* provided upstream from the contact portion in which the solid lubricant 3*b* is contacted by the application roller 3*a*, the leftward movement of the lubricant holder 3*d* in the direction in which the application roller 3*a* scrapes off the solid lubricant 3*d* may prevent the pressing member 31*d* of the lubricant holder 3*d* from contacting the rotary member 41. Consequently, the rotary member 41 is not rotated even when the solid lubricant 3*b* reaches the near-end stage.

By contrast, in the foregoing illustrative embodiment, the lubricant gauge 40 is mounted to the lateral face of the casing 3*e* provided downstream from the contact portion in which the application roller 3*a* contacts the solid lubricant 3*b* in the direction of rotation of the application roller 3*a*. As a result, the pressing member 31*d* securely contacts the rotary member 41, thereby reliably detecting the near-end stage of the solid lubricant 3*b*. In addition, both the lubricant holder 3*d* and the solid lubricant 3*b* are moved in the direction of rotation of the application roller 3*a*, that is, leftward in FIGS. 7A and 7B. Accordingly, the opening 31*e* is covered with the lubricant holder 3*d* and the solid lubricant 3*b*. As a result, the lubricant accumulating within the casing 3*e* is prevented from scattering outside the casing 3*e* through the opening 31*e*.

It is to be noted that, in the foregoing illustrative embodiments, the lubricant gauge 40 detects a state in which the solid lubricant 3*b* still has a slight amount remaining to be supplied to the surface of the photoconductor 1 for predetermined number of sequences of image formation. If the lubricant gauge 40 detects the last stage of use of the solid lubricant 3*b* immediately before exhaustion of the solid lubricant 3*b*, image formation is prohibited until the solid lubricant 3*b* is replaced with a new solid lubricant 3*b* in order to prevent irregular image formation caused by exhaustion of the solid lubricant 3*b*, thereby causing downtime.

By contrast, in the foregoing illustrative embodiments, the near-end stage of the solid lubricant 3*b* is detected as described above. Accordingly, the lubricant is still supplied to the surface of the photoconductor 1 for the predetermined number of sequences of image formation even after the detection of the near-end stage, thereby securely protecting the surface of the photoconductor 1. As a result, image formation is performed without downtime even after the detection until the replacement of the solid lubricant 3*b*. However, if image formation is performed at the predetermined number of sequences before the replacement of the solid lubricant 3*b*, the solid lubricant 3*b* is used up, causing the problems described previously. To prevent these problems, when the near-end stage of the solid lubricant 3*b* is detected, the cumulative distance traveled by the application roller 3*a*, the number of sequences of image formation performed, or the like is monitored. When the cumulative distance traveled by the application roller 3*a*, the number of sequences of image formation performed, or the like reaches a predetermined threshold, it is determined that the solid lubricant 3*b* is in the last stage of use, so that image formation is prohibited.

As described previously, the application roller 3*a* scrapes off the solid lubricant 3*b* to supply the lubricant thus scraped off to the surface of the photoconductor 1 while rotating. Thus, during the application of the lubricant to the surface of the photoconductor 1 by the application roller 3*a*, the solid lubricant 3*b* receives a force in the direction of rotation of the application roller 3*a*, that is, a leftward force in FIGS. 7A and 7B. In addition, the lubricant holder 3*d* is configured to be movable within the casing 3*e*. In other words, the lubricant holder 3*d* is accommodated within the casing 3*e* with play. The above configuration may incline the lubricant holder 3*d* holding the solid lubricant 3*b* counterclockwise in FIGS. 7A and 7B, which corresponds to the direction in which the application roller 3*a* scrapes off the solid lubricant 3*b*, when the solid lubricant 3*b* receives the leftward force in the direction of rotation of the application roller 3*a*. In the foregoing illustrative embodiments, the pressing member 31*d* is mounted to a lateral face of the lubricant holder 3*d* provided downstream in the direction of rotation of the application roller 3*a* as illustrated in FIGS. 7A and 7B. Consequently, when the lubricant holder 3*d* tilts as described above, the pressing member 31*d* presses the rotary member 41 and thus electrical continuity is established between the first and second electrode members 42*a* and 42*b* before the solid lubricant 3*b* reaches the near-end stage. As a result, the control unit 100 erroneously detects the near-end stage of the solid lubricant 3*b*.

In addition, during the application of the lubricant, the solid lubricant 3*b* vibrates against the rotation of the application roller 3*a* due to load fluctuation at the contact portion in which the application roller 3*a* contacts the solid lubricant 3*b*. In particular, the configuration of the foregoing illustrative embodiments, in which a direction of gravity of the solid lubricant 3*b* is opposite to the direction of rotation of the application roller 3*a* against the solid lubricant 3*b*, increases the vibration of the solid lubricant 3*b* caused by the load fluctuation. Further, fluctuation in the rotation of the application roller 3*a* also vibrates the solid lubricant 3*b*. Consequently, even if the lubricant holder 3*d* does not tilt during the application of the lubricant, a force of the pressing member 31*d* that presses the rotary member 41 in the near-end stage of the solid lubricant 3*b* changes due to the vibration of the solid lubricant 3*b*. As a result, the force in which the rotary member 41 presses the second electrode member 42*b* against the first electrode member 42*a* varies, causing irregular contact of the second electrode member 42*b* with the first electrode member 42*a*. Consequently, electrical continuity between the first and second electrode members 42*a* and 42*b* is repeatedly established and broken. Thus, the vibration of the solid lubricant 3*b* may hinder establishment of electrical continuity between the first and second electrode members 42*a* and 42*b* and detection of the near-end stage of the solid lubricant 3*b* even when the solid lubricant 3*b* reaches the near-end stage. In addition, irregular contact of the second electrode member 42*b* with the first electrode member 42*a* caused by the vibration of the solid lubricant 3*b* may generate noise or the like, and such noise or the like may adversely affect establishment of electrical continuity between the first and second electrode members 42*a* and 42*b*. Consequently, an amount of electricity is increased in order to prevent the noise from adversely affecting establishment of electrical continuity between the first and second electrode members 42*a* and 42*b*. For these reasons, in the foregoing illustrative embodiments, the near-end stage of the solid lubricant 3*b* is detected when the application roller 3*a* is not rotated and thus the lubricant is not supplied to the surface of the photoconductor 1.

Figure 20:
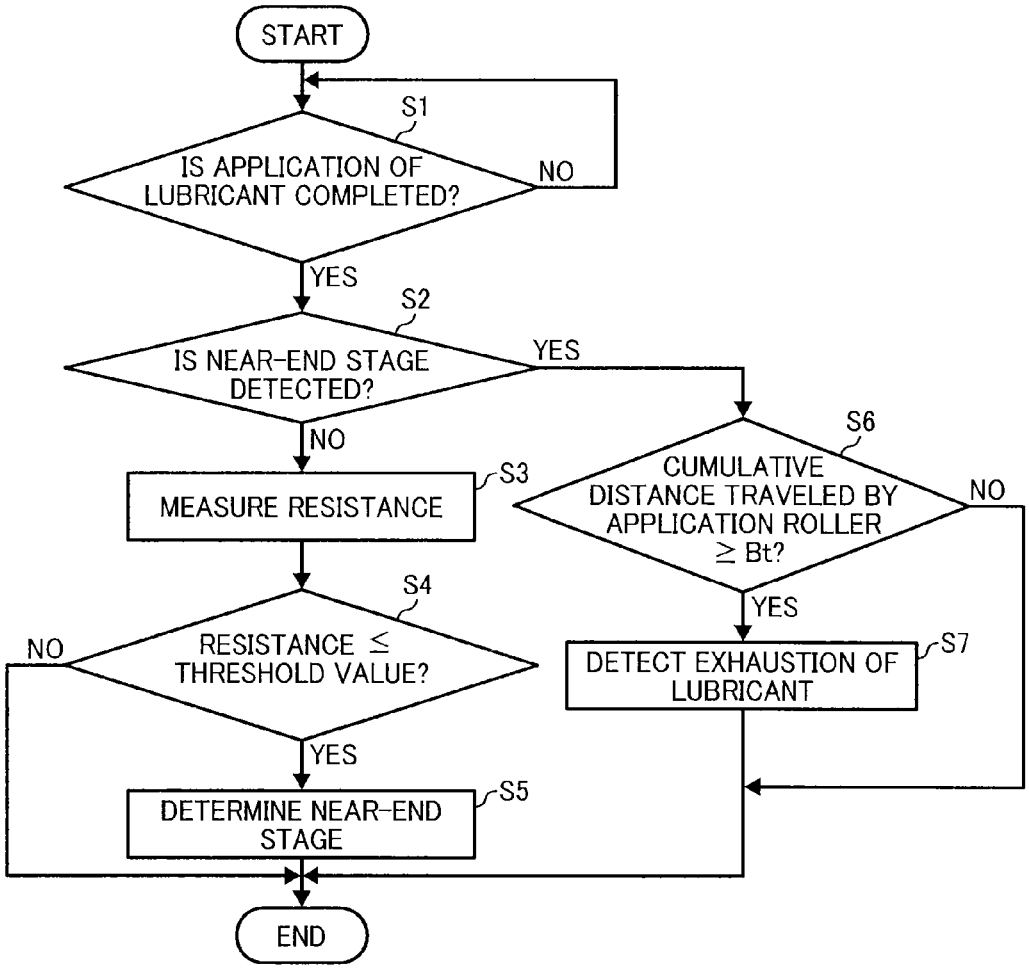
FIG. 20 is a flowchart illustrating steps in a process of detecting the near-end stage of the solid lubricant.

FIG. 20 is a flowchart illustrating steps in a process of detecting the near-end stage of the solid lubricant 3*b*.

At step S1, the control unit 100 checks whether or not the application of lubricant to the surface of the photoconductor 1 by the application roller 3*a* is completed. At this time, in a case in which the application roller 3*a* is rotatively driven, whether a drive motor, not shown, that rotatively drives the application roller 3*a* is turned off is detected to detect completion of the application of lubricant. Alternatively, in a case in which the application roller 3*a* is rotated as the photoconductor 1 rotates, whether a drive motor, not shown, that rotatively drives the photoconductor 1 is turned off is detected to detect completion of the application of lubricant. Further alternatively, an encoder or the like that detects completion of the rotation of the application roller 3*a* may be used to detect completion of the application of lubricant.

When the application of lubricant is completed (YES at S1), the process proceeds to step S2 so that the control unit 100 detects whether or not the near-end stage of the solid lubricant 3*b* is detected. When the near-end stage of the solid lubricant 3*b* is not detected (NO at S2), the process proceeds to step S3 so that a voltage is applied between the first and second electrode members 42*a* and 42*b* to measure an electrical resistance using the resistance detector 42*c*. At step S4, the control unit 100 determines whether or not the electrical resistance detected by the resistance detector 42*c* is less than a threshold value. When the electrical resistance thus detected is less than the threshold value (YES at S4), the process proceeds to step S5 to determine that the solid lubricant 3*b* reaches the near-end stage and notify the user of the near-end stage of the solid lubricant 3*b*.

Meanwhile, when the near-end stage of the solid lubricant 3*b* is detected (YES at S2), the process proceeds to step S6 to determine whether or not a cumulative distance traveled by the application roller 3*a* after the detection of the near-end stage is greater than a threshold value Bt. When the cumulative distance traveled by the application roller 3*a* is greater than the threshold value Bt (YES at S6), the process proceeds to step S7 so that the control unit 100 detects that the solid lubricant 3*b* is used up and prohibits image formation.

Thus, the amount of solid lubricant 3*b* is detected after the completion of application of lubricant to the surface of the photoconductor 1 in a state in which the lubricant holder 3*d* is not tilted, thereby accurately detecting the amount of solid lubricant 3*b* remaining. In addition, in the foregoing illustrative embodiments, the amount of solid lubricant 3*b* is detected in a state in which the solid lubricant 3*b* does not vibrate. Accordingly, the second electrode member 42*b* securely contacts the first electrode member 42*a* in the near-end stage of the solid lubricant 3*b*, thereby accurately detecting the near-end stage of the solid lubricant 3*b*. Further, establishment of the electrical continuity between the first and second electrode members 42*a* and 42*b* is reliably detected without applying a high voltage between the first and second electrode members 42*a* and 42*b*, thereby minimizing power consumption. Although the amount of the solid lubricant 3*b* is detected after the completion of application of lubricant in the above-described example, alternatively, it may be detected before the application of lubricant to the surface of the photoconductor 1. Further alternatively, the last stage of use of the solid lubricant 3*b* may be detected each time after the detection of the near-end stage of the solid lubricant 3*b*.

In a usage condition in which an image with a lower area ratio is often formed, powdered lubricant, which is not supplied to the surface of the photoconductor 1 from the application roller 3*a*, accumulates also at the center of the casing 3*e*. Consequently, even in the configuration having the opening 31*e* at a position closer to the center of the casing 3*e*, a larger amount of powdered lubricant scatters from the opening 31*e* under such a usage condition. As a result, the powdered lubricant tends to enter, through a communication part formed in the partition wall 43*b* through which the rotary member 41 penetrates, the part of the internal space encompassed by the cover member 43 in which the first and second electrode members 42*a* and 42*b* are disposed. Consequently, an increase in the amount of lubricant adhering to the first or second electrode member 42*a* or 42*b* causes irregular electrical continuity between the first and second electrode members 42*a* and 42*b*, resulting in erroneous detection of the near-end stage of the solid lubricant 3*b*. To prevent the above-described problems, the near-end stage of the solid lubricant 3*b* may be detected based on both the cumulative distance traveled by the application roller 3*a* and the establishment of electrical continuity between the first and second electrode members 42*a* and 42*b*.

Figure 21:
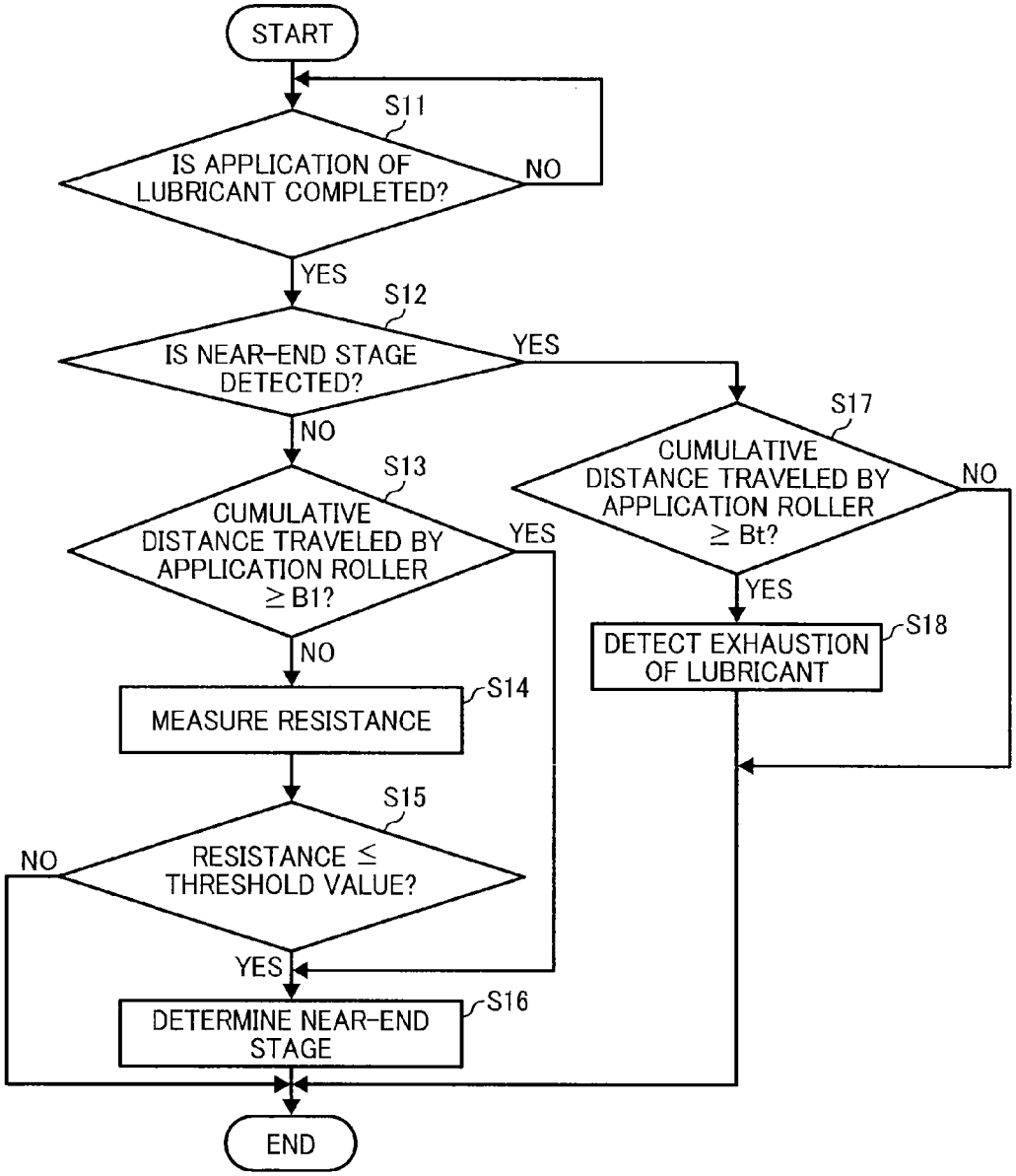
FIG. 21 is a flowchart illustrating steps in a process of detecting the near-end stage of the solid lubricant based on both a result detected by the lubricant gauge and a cumulative distance traveled by an application roller.

FIG. 21 is a flowchart illustrating steps in a process of detecting the near-end stage of the solid lubricant 3*b* based on both the result detected by the lubricant gauge 40 and the cumulative distance traveled by the application roller 3*a*.

At step S11, the control unit 100 checks whether or not the application of lubricant to the surface of the photoconductor 1 by the application roller 3*a* is completed. When the application of lubricant is completed (YES at S11), the process proceeds to step S12 to determine whether or not the lubricant gauge 40 detects the near-end stage of the solid lubricant 3*b*. When the lubricant gauge 40 does not detect the near-end stage of the solid lubricant 3*b* (NO at S12), the process proceeds to step S13 to check whether or not the cumulative distance traveled by the application roller 3*a* is greater than a threshold value B1. When the cumulative distance traveled by the application roller 3*a* is less than the threshold value B1 (NO at S13), the process proceeds to step S14 so that the resistance detector 42*c* measures an electrical resistance. At step S15, the control unit 100 checks whether or not the electrical resistance thus measured by the resistance detector 42*c* is less than a threshold value. When the electrical resistance thus measured is less than the threshold value and thus electrical continuity is established between the first and second electrode members 42*a* and 42*b* (YES at S15), at step S16 the control unit 100 determines that the solid lubricant 3*b* reaches the near-end stage and notifies the user of the near-end stage of the solid lubricant 3*b*.

When the cumulative distance traveled by the application roller 3*a* is greater than the threshold value B1 (YES at S13), the process proceeds to step S16 so that the control unit 100 determines that the solid lubricant 3*b* reaches the near-end stage and notifies the user of the near-end stage of the solid lubricant 3*b*.

Meanwhile, when the near-end stage of the solid lubricant 3*b* is detected (YES at S12), the process proceeds to step S17 to determine whether or not a cumulative distance traveled by the application roller 3*a* after the detection of the near-end stage is greater than a threshold value Bt. When the cumulative distance traveled by the application roller 3*a* is greater than the threshold value Bt (YES at S17), the process proceeds to step S18 so that the control unit 100 detects that the solid lubricant 3*b* is used up and prohibits image formation.

Figure 22:
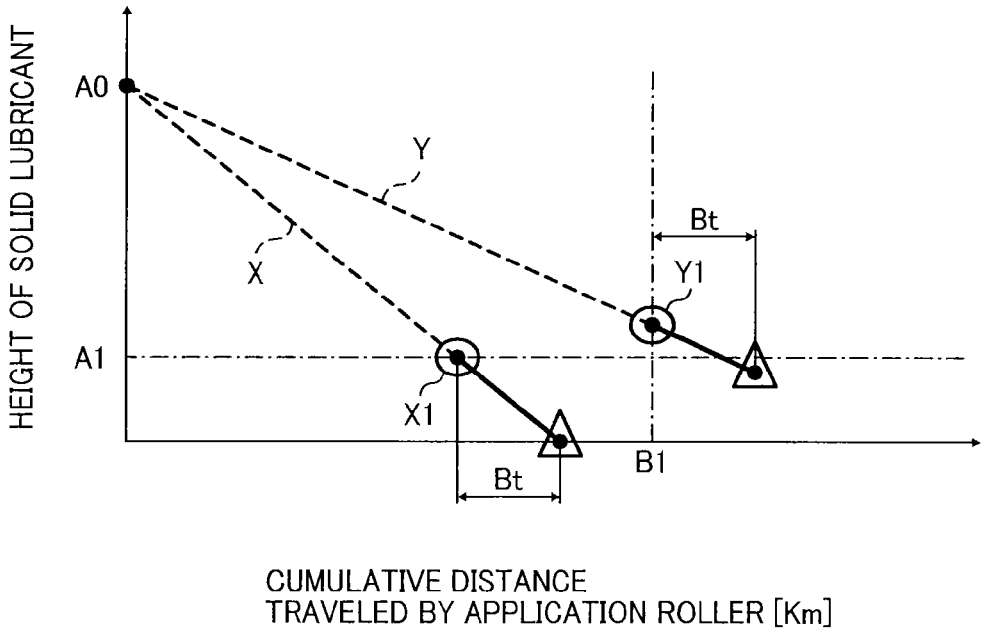
FIG. 22 is a graph showing a relation between a transition in an amount of solid lubricant and a timing to detect the near-end stage of the solid lubricant.

FIG. 22 is a graph showing a relation between a transition in the amount of solid lubricant 3*b* and a timing to detect the near-end stage of the solid lubricant 3*b*. In FIG. 22, electrical continuity is established between the first and second electrode members 42*a* and 42*b* when the height of the solid lubricant 3*b* reaches a value A1.

Under a normal usage condition indicated by broken line X in FIG. 22, electrical continuity is established between the first and second electrode members 42*a* and 42*b* at a timing X1 before the cumulative distance traveled by the application roller 3*a* has the threshold value B1, so that the near-end stage of the solid lubricant 3*b* is detected at the timing X1. Meanwhile, under the usage condition in which an image with a lower area ratio is often formed, which is indicated by broken line Y in FIG. 22, the cumulative distance traveled by the application roller 3*a* reaches the threshold value B1 at a timing Y1 before electrical continuity is established between the first and second electrode members 42*a* and 42*b*, so that the near-end stage of the solid lubricant 3*b* is detected at the timing Y1. With regard to the normal usage condition, when the cumulative distance traveled by the application roller 3*a* reaches the threshold value Bt after the detection of the near-end stage of the solid lubricant 3*b*, the control unit 100 determines that the solid lubricant 3*b* is in the last stage of use and prohibits image formation.

As described above, under the usage condition in which an image with a lower area ratio is often formed, the near-end stage of the solid lubricant 3*b* may not be detected by the lubricant gauge 40, and therefore, the cumulative distance traveled by the application roller 3*a* is also used to reliably detect the near-end stage of the solid lubricant 3*b*. Thus, the near-end stage of the solid lubricant 3*b* is reliably detected, thereby securely protecting the surface of the photoconductor 1 with the lubricant.

Alternatively, a rotation time of the application roller 3*a* may be measured to detect the near-end stage of the solid lubricant 3*b*. In a configuration in which the number of rotation of the application roller 3*a* is controlled based on environmental changes or the like, the cumulative distance traveled by the application roller 3*a* is measured to more accurately predict the near-end stage of the solid lubricant 3*b*.

It is to be noted that, in the above-described example, the cumulative distance traveled by the application roller 3*a* when the solid lubricant 3*b* reaches the near-end stage under the usage condition in which an image with a lower area ratio is often formed is used as the threshold value B1. Alternatively, in a case in which the process cartridge 11 includes a component that ends its product life before the solid lubricant 3*b* reaches the near-end stage under the usage condition in which an image with a lower area ratio is often formed, the cumulative distance traveled by the application roller 3*a* when that components ends its product life may be used as the threshold value B1.

Figure 23:
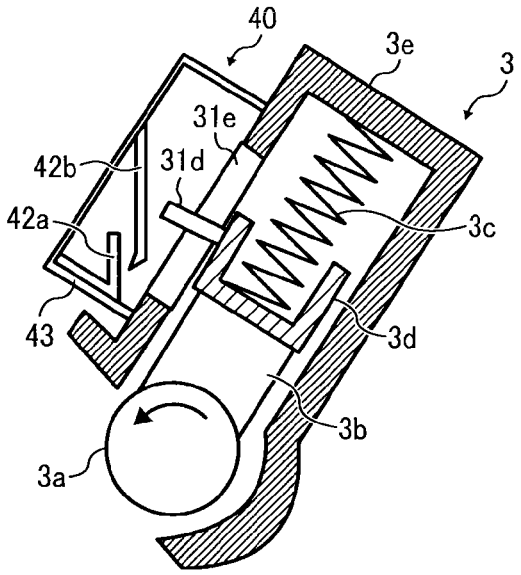
FIG. 23 is a vertical cross-sectional view illustrating an example of a configuration of a lubricant gauge according to a first variation.

FIG. 23 is a vertical cross-sectional view illustrating an example of a configuration of the lubricant gauge 40 according to a first variation of the foregoing illustrative embodiments. In the first variation, the first and second electrode members 42*a* and 42*b* are horizontally aligned to face each other. Accordingly, the first and second electrode members 42*a* and 42*b* face vertically in a direction perpendicular to the horizontal direction. Such a configuration prevents accumulation of the powdered lubricant on the first and second electrode members 42*a* and 42*b* and thus prevents irregular electrical continuity between the first and second electrode members 42*a* and 42*b*, thereby accurately detecting the near-end stage of the solid lubricant 3*b*.

Figure 24:
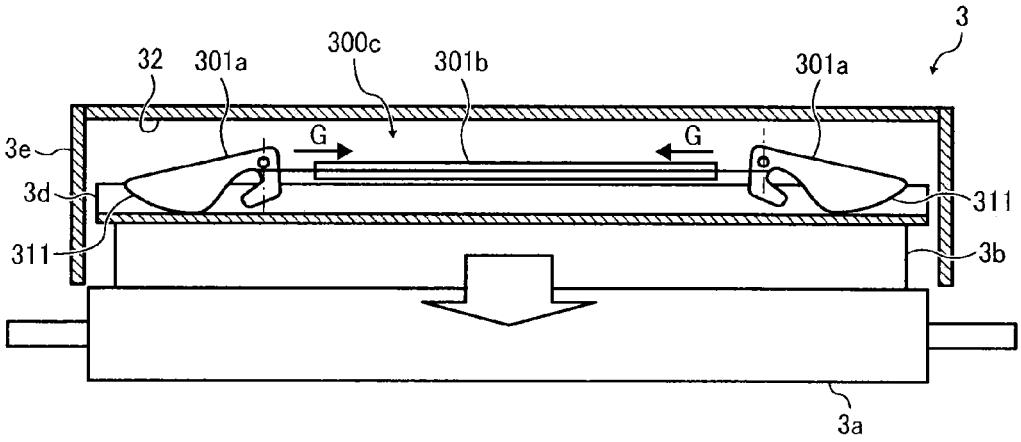
FIG. 24 is a schematic view illustrating an example of a configuration of a pressing mechanism included in the lubricant applicator according to a first variation.

A description is now given of an example of a configuration of a pressing mechanism 300*c*, which is a variation of the pressing mechanism 3*c* included in the lubricant applicator 3 according to the foregoing illustrative embodiments. FIG. 24 is a schematic view illustrating an example of a configuration of the pressing mechanism 300*c*.

The pressing mechanism 300*c* is constructed of swinging members 301*a* swingably provided to the casing 3*e* near both ends of the lubricant holder 3*d* in the longitudinal direction, respectively, and a biasing member, that is, a spring 301*b*. Specifically, both ends of the spring 301*b* are mounted to the respective swinging members 301*a*. The swinging members 301*a* are biased inward to the center of the lubricant holder 3*d* in the longitudinal direction as indicated by arrows G in FIG. 24 by the spring 301*b*. Accordingly, the swinging member 301*a* positioned on the right in FIG. 24 swings in a counter-clockwise direction, and the swinging member 301*a* positioned on the left in FIG. 24 swings in a clockwise direction. As a result, an arc-shaped edge portion 311 of each swinging member 301*a* that contacts the lubricant holder 3*d* is biased toward the lubricant holder 3*d* as illustrated in FIG. 24.

In the early stage of use of the solid lubricant 3*b*, the swinging members 301*a* swing toward an inner surface 32 of an upper portion of the casing 3*e* against the biasing force of the spring 301*b*. Such a configuration enables the swinging members 301*a* biased by the spring 301*b* to press against the lubricant holder 3*d* with an equal force, so that the solid lubricant 3*b* held by the lubricant holder 3*d* is evenly pressed against the application roller 3*a* across the longitudinal direction. As a result, an amount of lubricant scraped off by rotation of the application roller 3*a* is equal across the longitudinal direction, and therefore, the lubricant is evenly supplied to the surface of the photoconductor 1.

Thus, the pressing mechanism 300*c* presses the solid lubricant 3*b* against the application roller 3*a* with substantially the same force over time even as the solid lubricant 3*b* is reduced. As a result, unevenness in the amount of powdered lubricant scraped off by the application roller 3*a* and supplied to the surface of the photoconductor 1 is minimized from the early stage to the last stage of use of the solid lubricant 3*b*.

The following are reasons for obtaining the above-described effects.

In general, the longer the length of the spring 301*b*, the smaller the variation in a biasing force of the spring 301*b* relative to a change in an amount of extension of the spring 301*b* from the early stage to the last stage of use of the solid lubricant 3*b*. If the spring 301*b* in a compressed state is disposed within the casing 3*e* and a direction of a biasing force of the spring 301*b* is identical to a direction in which the solid lubricant 3*b* is pressed against the application roller 3*a*, the longer the length of the spring 301*b*, the more difficult it is to set the direction of the biasing force of the spring 301*b* to be identical to the direction in which the solid lubricant 3*b* is pressed against the application roller 3*a*. Thus, the length of the spring 301*b* is limited. Further, in the above-described configuration, a space for the length of the spring 301*b* is needed in a direction of the diameter of the application roller 3*a*, resulting in an increase in the overall size of the lubricant applicator 3. For these reasons, in the above-described configuration, a relatively short spring 301*b* is used, making the pressing mechanism 300*c* vulnerable to variation in the biasing force of the spring over time.

By contrast, in the pressing mechanism 300*c* illustrated in FIG. 24, the spring 301*b* in the extended state is disposed within the casing 3*e*, and attractive force of the spring 301*b* is used for pressing the solid lubricant 3*b* against the application roller 3*a*. Thus, even the longer spring 301*b* does not cause the problems described above. In addition, in the pressing mechanism 300*c*, the spring 301*b* is disposed such that the longitudinal direction of the spring 301*b* is identical to the longitudinal direction of the solid lubricant 3*b*, that is, an axial direction of the application roller 3*a*. Therefore, use of the longer spring 301*b* does not increase a space for the spring 301*b* in the direction of diameter of the application roller 3*a*, thereby allowing the lubricant applicator 3*a* to be made more compact. Thus, the pressing mechanism 300*c* illustrated in FIG. 24 employs the relatively longer spring 301*b*. As a result, variation in the biasing force of the spring 301*b* over time is minimized.

Figure 25:
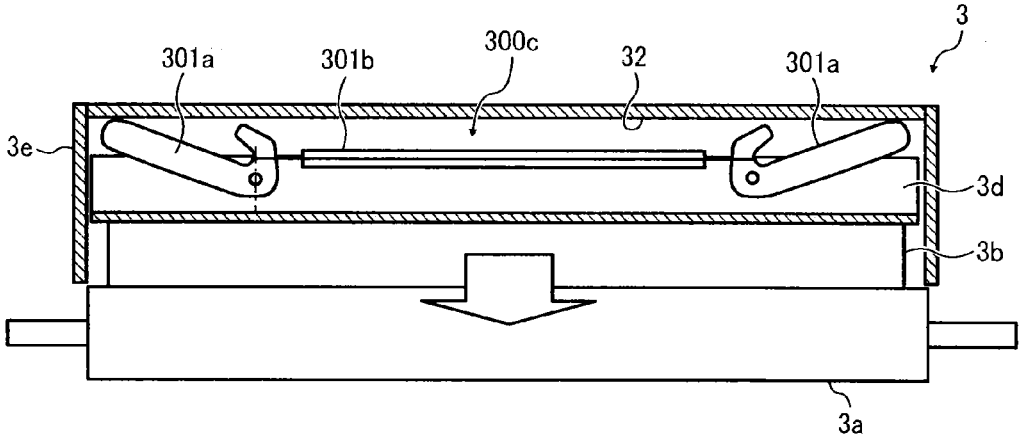
FIG. 25 is a schematic view illustrating an example of a configuration of a pressing mechanism included in the lubricant applicator according to a second variation.

Alternatively, the swinging members 301*a* may be swingably mounted to the lubricant holder 3*d* as illustrated in FIG. 25. In the configuration illustrated in FIG. 25, the spring 301*b* biases the swinging members 301*a* toward the center of the lubricant holder 3*d* in the longitudinal direction so that a free end of each swinging member 301*a* is biased away from the lubricant holder 3*d* to contact the inner surface 32 of the upper portion of the casing 3*e*.

Figure 26:
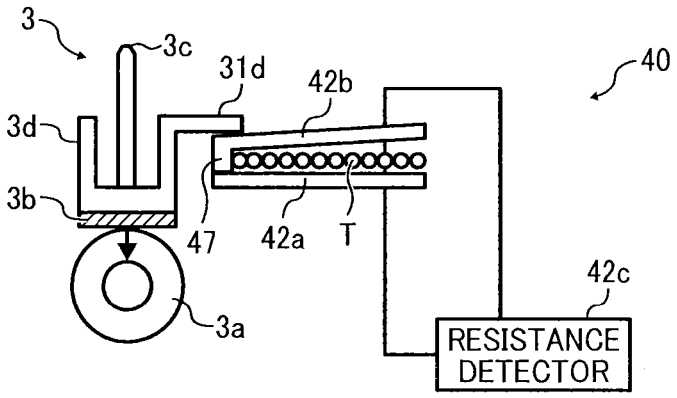
FIG. 26 is a schematic view illustrating an example of a configuration of a lubricant gauge according to a second variation.

FIG. 26 is a schematic view illustrating an example of a configuration of the lubricant gauge 40 according to a second variation of the foregoing illustrative embodiments. As illustrated in FIG. 26, the pressing member 31*d* of the lubricant holder 3*d* may directly contact the second electrode member 42*b*. In such a configuration, the second electrode member 42*b* is disposed above the first electrode member 42*a*, and consequently, the powdered lubricant T or the like accumulates on the upper surface of the first electrode member 42*a*, which is contacted by the projections 47 provided to the free end of the second electrode member 42*b*. However, as described previously, the lubricant T is easily removed from the first electrode member 42*a* by the projections 47 of the second electrode member 42*b*, and therefore, the projections 47 reliably contact the first electrode member 42*a*.

The foregoing illustrative embodiment is applicable to a lubricant applicator that supplies lubricant to the intermediate transfer belt 56

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A lubricant applicator, comprising:

a lubricant;

a supply member contactable against the lubricant; and a lubricant detector comprising:

a first electrode; and a second electrode, the lubricant detector electrically connected to the first electrode and the second electrode to detect establishment of electrical continuity between the first electrode and the second electrode, one of the first electrode and the second electrode comprising a projection projecting toward the other one of the first electrode and the second electrode.

2. The lubricant applicator according to claim 1, further comprising multiple projections provided to one of the first electrode and the second electrode and projecting toward the other one of the first electrode and the second electrode.

3. The lubricant applicator according to claim 1, wherein a tip of the projection is contactable against the other one of the first electrode and the second electrode at a point or along a line.

4. The lubricant applicator according to claim 1, further comprising a lubricant holder to hold the lubricant, wherein:

the lubricant holder directly or indirectly presses the second electrode to deform the second electrode with one end of the second electrode as a pivot; and the projection is provided to the other end of the second electrode.

5. The lubricant applicator according to claim 1, wherein the second electrode is vertically aligned with the first electrode; and a horizontal projection area of one of the first electrode and the second electrode disposed above the other is larger than a horizontal projection area of the other one of the first electrode and the second electrode at a contact part in which the first electrode and the second electrode contact each other.

6. The lubricant applicator according to claim 1, wherein the first electrode and the second electrode are horizontally aligned.

7. The lubricant applicator according to claim 1, further comprising a cleaner to rub a contact part of the second electrode that contacts the first electrode and remove foreign substances from the contact part of the second electrode during movement of the second electrode toward the first electrode, wherein the first electrode and the second electrode are vertically aligned.

8. The lubricant applicator according to claim 7, wherein the second electrode is disposed below the first electrode.

9. The lubricant applicator according to claim 1, further comprising a shield to encompass and shield the projection.

10. The lubricant applicator according to claim 9, wherein the shield is formed of an insulating deformable material and extending beyond the projection toward the other one of the first electrode and the second electrode to shield a contact part of the other one of the first electrode and the second electrode contacted by the projection.

11. The lubricant applicator according to claim 1, further comprising a casing to accommodate the lubricant, wherein the lubricant detector is disposed outside the casing.

12. The lubricant applicator according to claim 11, further comprising:

a pressing member to directly or indirectly press the second electrode as the lubricant is consumed;

an opening formed in the casing, through which the pressing member penetrates; and a cover member to cover the lubricant detector and the opening.

13. The lubricant applicator according to claim 12, wherein the cover member holds the lubricant detector.

14. The lubricant applicator according to claim 12, further comprising a rotary member pressed and rotated by the pressing member as the lubricant is consumed to press the second electrode against the first electrode.

15. The lubricant applicator according to claim 14, further comprising a partition to isolate the lubricant detector from the opening.

16. The lubricant applicator according to claim 1, wherein the lubricant detector is disposed at multiple positions across a longitudinal direction of the lubricant.

17. The lubricant applicator according to claim 1, wherein one of the first electrode and the second electrode includes multiple projections projecting toward the other one of the first electrode and the second electrode, and the multiple projections are angled away from each other.

18. The lubricant applicator according to claim 1, wherein the lubricant detector detects whether an amount of lubricant remaining is less than a threshold value based on the establishment of electrical continuity between the first electrode and the second electrode.

19. An image forming apparatus, comprising:

an image carrier, from which an image formed thereon is transferred onto a recording medium to form the image on the recording medium; and a lubricant applicator disposed opposite the image carrier to supply a lubricant to a surface of the image carrier, the lubricant applicator comprising:

a lubricant;

a supply member contactable against the lubricant; and a lubricant detector comprising:

a first electrode; and a second electrode, the lubricant detector electrically connected to the first electrode and the second electrode to detect establishment of electrical continuity between the first electrode and the second electrode, one of the first electrode and the second electrode comprising a projection projecting toward the other one of the first electrode and the second electrode.

20. A process cartridge detachably installable in an image forming apparatus, comprising:

an image carrier; and a lubricant applicator disposed opposite the image carrier to supply a lubricant to a surface of the image carrier, the lubricant applicator comprising:

a lubricant;

a supply member contactable against the lubricant; and a lubricant detector comprising:

a first electrode; and a second electrode, the lubricant detector electrically connected to the first electrode and the second electrode to detect establishment of electrical continuity between the first electrode and the second electrode, one of the first electrode and the second electrode comprising a projection projecting toward the other one of the first electrode and the second electrode.

* * * * *